US008655214B2

(12) United States Patent
Sugiyama et al.

(10) Patent No.: US 8,655,214 B2
(45) Date of Patent: Feb. 18, 2014

(54) IMAGE FORMING APPARATUS FOR FIXING A NOT-YET-FIXED IMAGE

(75) Inventors: Hiroyuki Sugiyama, Kanagawa (JP); Jun Yura, Kanagawa (JP); Tokuya Ojimi, Kanagawa (JP); Yukiko Iwasaki, Kanagawa (JP); Jun Shiori, Kanagawa (JP); Masaki Sukesako, Kanagawa (JP); Kazuaki Kamihara, Tokyo (JP); Hironobu Takeshita, Kanagawa (JP)

(73) Assignee: Ricoh Company, Ltd., Tokyo (JP)

( * ) Notice: Subject to any disclaimer, the term of this patent is extended or adjusted under 35 U.S.C. 154(b) by 190 days.

(21) Appl. No.: 13/286,732

(22) Filed: Nov. 1, 2011

(65) Prior Publication Data

US 2012/0114358 A1 May 10, 2012

(30) Foreign Application Priority Data

Nov. 4, 2010 (JP) ..... 2010-247493
Nov. 12, 2010 (JP) ..... 2010-253904

(51) Int. Cl.
*G03G 15/20* (2006.01)

(52) U.S. Cl.
USPC ..... 399/69

(58) Field of Classification Search
USPC ..... 399/69, 329
See application file for complete search history.

(56) References Cited

U.S. PATENT DOCUMENTS 5,708,949 A 1/1998 Kasahara et al.
5,768,659 A * 6/1998 Kameda ..... 399/111
6,559,421 B1 5/2003 Yura et al.
6,631,253 B2 10/2003 Nakafuji et al.
6,636,718 B2 10/2003 Yura et al.
6,646,227 B2 11/2003 Yura et al.
6,778,790 B2 8/2004 Yoshinaga et al.
6,795,676 B2 9/2004 Kikuchi et al.
6,795,678 B2 9/2004 Yura et al.
6,847,792 B2 1/2005 Nakafuji et al.
6,941,088 B2 9/2005 Atsushi et al.
7,010,255 B2 3/2006 Yura et al.
7,058,330 B2 6/2006 Nakafuji et al.
7,107,681 B2 9/2006 Yura et al.
7,224,928 B2 5/2007 Kikuchi et al.

(Continued)

FOREIGN PATENT DOCUMENTS

JP 3295273 4/2002
JP 2006-133580 5/2006

(Continued)

OTHER PUBLICATIONS

Machine Translation of JP 2007-271870.*

(Continued)

*Primary Examiner* — G. M. Hyder
(74) *Attorney, Agent, or Firm* — Oblon, Spivak, McClelland, Maier & Neustadt, L.L.P.

(57) ABSTRACT

An image forming apparatus including a fixing unit configured to fix a not-yet-fixed image on a recording medium, includes a fixing target temperature changing part configured to change a fixing target temperature at a time of a fixing process; and a gradation processing part configured to carry out gradation processing on image information. For each sheet of a recording medium on which the fixing process is carried out, the fixing target temperature is changed based on whether halftone processing is carried out and a type of gradation processing to be used.

20 Claims, 22 Drawing Sheets

(56) References Cited

U.S. PATENT DOCUMENTS

| | | | | |
|---|---|---|---|---|
| 7,251,429 | B2 | 7/2007 | Nakafuji et al. | |
| 7,346,305 | B2 | 3/2008 | Kikuchi et al. | |
| 7,620,336 | B2 | 11/2009 | Yura et al. | |
| 7,693,471 | B2 | 4/2010 | Kikuchi et al. | |
| 2006/0127144 | A1* | 6/2006 | Watanabe | 399/329 |
| 2009/0196638 | A1 | 8/2009 | Sukesako et al. | |
| 2009/0196644 | A1 | 8/2009 | Funatsu | |
| 2010/0021195 | A1 | 1/2010 | Yura et al. | |
| 2010/0046994 | A1 | 2/2010 | Kikuchi et al. | |
| 2011/0217061 | A1* | 9/2011 | Ichikawa et al. | 399/69 |

FOREIGN PATENT DOCUMENTS

| | | | |
|---|---|---|---|
| JP | 2007271870 | A * | 10/2007 |
| JP | 2008-185638 | | 8/2008 |
| JP | 2008-268784 | | 11/2008 |
| JP | 2009-53421 | | 3/2009 |
| JP | 2009-181065 | | 8/2009 |
| JP | 2011064907 | A * | 3/2011 |

OTHER PUBLICATIONS

U.S. Appl. No. 13/285,711, filed Oct. 31, 2011, Yura, et al.

* cited by examiner

FIG.4

| | IMAGE FORMING MODE | PHOTOGRAPH AREA | CHARACTER/LETTER AREA |
|---|---|---|---|
| PRINT | GENERAL DOCUMENT (SPEED PREFERRED) | CONCENTRATION TYPE 150[lpi] | CONCENTRATION TYPE 200[lpi] |
| | GENERAL DOCUMENT (IMAGE QUALITY PREFERRED) | LINE SCREEN TYPE 150[lpi] | DISPERSION TYPE 300[lpi] |
| | PHOTOGRAPH (IMAGE QUALITY PREFERRED) | LINE SCREEN TYPE 200[lpi] | DISPERSION TYPE 300[lpi] |
| | HIGH RESOLUTION | LINE SCREEN TYPE 250[lpi] | DISPERSION TYPE 600[lpi] |
| COPY | | ERROR DIFFUSION | |

FIG.6

| NUMBER OF LINES [lpi] | TYPE OF DITHERING | | |
|---|---|---|---|
| | CONCENTRATION TYPE | LINE SCREEN TYPE | DISPERSION TYPE |
| 150 | LEVEL 1 TEMPERATURE | LEVEL 1 TEMPERATURE | LEVEL 1 TEMPERATURE |
| 200 | LEVEL 1 TEMPERATURE | LEVEL 1 TEMPERATURE | NORMAL TEMPERATURE |
| 250 | NORMAL TEMPERATURE | NORMAL TEMPERATURE | NORMAL TEMPERATURE |
| 300 | NORMAL TEMPERATURE | NORMAL TEMPERATURE | NORMAL TEMPERATURE |

FIG.7

| IMAGE FORMING MODE | PHOTOGRAPH AREA | | CHARACTER/LETTER AREA | |
|---|---|---|---|---|
| | INCLUDING IMAGE OF LESS THAN 100% | INCLUDING ONLY 100% IMAGE | INCLUDING IMAGE OF LESS THAN 100% | INCLUDING ONLY 100% IMAGE |
| GENERAL DOCUMENT (SPEED PREFERRED) | LEVEL 1 TEMPERATURE | LEVEL 2 TEMPERATURE | LEVEL 1 TEMPERATURE | LEVEL 2 TEMPERATURE |
| GENERAL DOCUMENT (IMAGE QUALITY PREFERRED) | LEVEL 1 TEMPERATURE | LEVEL 2 TEMPERATURE | NORMAL TEMPERATURE | LEVEL 2 TEMPERATURE |
| PHOTOGRAPH (IMAGE QUALITY PREFERRED) | LEVEL 1 TEMPERATURE | LEVEL 2 TEMPERATURE | NORMAL TEMPERATURE | LEVEL 2 TEMPERATURE |
| HIGH RESOLUTION | NORMAL TEMPERATURE | NORMAL TEMPERATURE | NORMAL TEMPERATURE | NORMAL TEMPERATURE |

FIG.13A

[AT TIME OF FULL-COLOR PRINTING]

| IMAGE FORMING MODE | PHOTOGRAPH AREA | | CHARACTER/LETTER AREA | |
|---|---|---|---|---|
| | INCLUDING IMAGE OF LESS THAN 100% | INCLUDING ONLY 100% IMAGE | INCLUDING IMAGE OF LESS THAN 100% | INCLUDING ONLY 100% IMAGE |
| GENERAL DOCUMENT (SPEED PREFERRED) | NORMAL TEMPERATURE | NORMAL TEMPERATURE | NORMAL TEMPERATURE | NORMAL TEMPERATURE |
| GENERAL DOCUMENT (IMAGE QUALITY PREFERRED) | NORMAL TEMPERATURE | NORMAL TEMPERATURE | NORMAL TEMPERATURE | NORMAL TEMPERATURE |
| PHOTOGRAPH (IMAGE QUALITY PREFERRED) | NORMAL TEMPERATURE | NORMAL TEMPERATURE | NORMAL TEMPERATURE | NORMAL TEMPERATURE |
| HIGH RESOLUTION | NORMAL TEMPERATURE | NORMAL TEMPERATURE | NORMAL TEMPERATURE | NORMAL TEMPERATURE |

FIG.13B

[AT TIME OF MONOCHROME PRINTING]

| IMAGE FORMING MODE | PHOTOGRAPH AREA | | CHARACTER/LETTER AREA | |
|---|---|---|---|---|
| | INCLUDING IMAGE OF LESS THAN 100% | INCLUDING ONLY 100% IMAGE | INCLUDING IMAGE OF LESS THAN 100% | INCLUDING ONLY 100% IMAGE |
| GENERAL DOCUMENT (SPEED PREFERRED) | LEVEL 2 TEMPERATURE | LEVEL 3 TEMPERATURE | LEVEL 2 TEMPERATURE | LEVEL 3 TEMPERATURE |
| GENERAL DOCUMENT (IMAGE QUALITY PREFERRED) | LEVEL 2 TEMPERATURE | LEVEL 3 TEMPERATURE | LEVEL 1 TEMPERATURE | LEVEL 3 TEMPERATURE |
| PHOTOGRAPH (IMAGE QUALITY PREFERRED) | LEVEL 2 TEMPERATURE | LEVEL 3 TEMPERATURE | LEVEL 1 TEMPERATURE | LEVEL 3 TEMPERATURE |
| HIGH RESOLUTION | LEVEL 1 TEMPERATURE | LEVEL 1 TEMPERATURE | LEVEL 1 TEMPERATURE | LEVEL 1 TEMPERATURE |

IMAGE FORMING APPARATUS FOR FIXING A NOT-YET-FIXED IMAGE

BACKGROUND OF THE INVENTION

1. Field of the Invention

The present invention relates to an image forming apparatus such as a copier, a printer, a facsimile machine, a multifunction peripheral having a function of combining of respective functions of a copier, a printer and a facsimile machine, or such.

2. Description of the Related Art

A fixing unit of melting and fixing a toner (developer) having adhered to a sheet of paper is provided in an image forming apparatus of an electrophotographic type such as a copier, a printer, a facsimile machine, a multifunction peripheral having a function of combining of respective functions of a copier, a printer and a facsimile machine, or such. In the fixing unit, a temperature (fixing temperature) necessary to fix a not-yet-fixed toner image is previously set. However, the necessary fixing temperature may depend on a type of the toner image, a type of the sheet of paper and so forth.

For example, as situations on which the fixing temperature depends, a concentration of a toner having adhered to a sheet of paper and an amount of isolated toner dots having adhered to the sheet of paper may be cited. In a case where a coverage ratio is high and the number of isolated dots is large, the fixing temperature is to be increased to be higher in comparison to a case where a coverage ratio is low and the number of isolated dots is small. Therefore, in an image forming apparatus in the related art, the fixing target temperature is set to meet a severest situation where fixing can be least easily achieved.

However, if fixing is carried out under a fixing condition set to meet a severest situation where fixing can be least easily achieved even in a case where an actual situation is not so sever so that fixing may be easily be achieved, the fixing temperature may be maintained at an unnecessarily high temperature according to the set fixing condition. Therefore, wasteful power consumption may occur in a heating unit, and this may be disadvantageous to the recent demand of saving energy.

Therefore, as will be described below, technologies by which a fixing condition is changed to be suitable between a situation where a toner image can be easily fixed and a situation where a toner image cannot be easily fixed have been proposed.

For example, Patent Document 1 (Japanese Laid-Open Patent Application Publication No. 2009-053421) discloses a technology in which a nip width is adjusted depending on a toner amount of an image to be fixed, and thus, fixing heat quality is optimized.

Patent Document 2 (Japanese Laid-Open Patent Application Publication No. 2006-133580) discloses a technology in which data is analyzed for each pixel, and a fixing temperature is increased in a case of low consumption mode (where toner consumption is reduced) in which an area coverage modulation process is carried out by using a part of carrying out a dither process for black pixels where the number of pixels is large or a part of creating a halftone image by controlling a laser-turning-on period of time in dot units.

Patent Document 3 (Japanese Patent No. 3295273) discloses a technology in which a fixing-starting-up period of time is changed between a character/letter mode and a photograph mode.

Patent Document 4 (Japanese Laid-Open Patent Application Publication No. 2008-185638) discloses a technology in which it is determined whether a colored small pixel is disposed in an isolated manner and a fixing temperature is controlled.

Patent Document 5 (Japanese Laid-Open Patent Application Publication No. 2008-268784) discloses a technology in which in a case where a coverage ratio is high such as a photograph, an optimum fixing temperature is increased in comparison to a case where a coverage ratio is low. Further, Patent Document 5 discloses a technology in which a converge ratio of each of a photograph area and a character/letter area is obtained, and a fixing temperature is controlled to a temperature optimum to each of these areas.

Patent Document 6 (Japanese Laid-Open Patent Application Publication No. 2009-181065) discloses a technology in which in order to control a fixing temperature to an optimum temperature, the fixing temperature is controlled according to image density information based on the number of data dots per certain area.

However, in these related arts, optimum temperature control may be achieved in a case where one recording medium is used to form an image or a case where image forming is carried out in a fixed mode (for example, a photograph mode or a character/letter mode). However, such a manner of control that a fixing temperature is changed for each of plural sheets of paper which are being successively processed is not considered and these related arts may not be suitable for carrying out temperature control for each page during successive processing of plural pages.

More specifically, in the technology of Patent Document 1, it may be very difficult to adjust the nip width for each page during a successive process of plural sheets of paper. It may not be realistic to carry out the control during a successive process of plural sheets of paper in a recent environment where an increase in process speed of an image forming apparatus is being progressed.

Also in the technologies of Patent Documents 2 and 3, a fixing temperature is controlled according to a selected mode, and changing the fixing temperature for each sheet of recording media during a successive process of plural sheets of recording media may not be considered.

In the technology of Patent Document 4, an image is divided into pixels each having a very small area, each pixel is further divided into smaller pixels each having a further smaller area, and fixing control is changed depending on coloring area of each smaller pixel. Therefore, if temperature control is carried out for each sheet of plural sheets of paper during a successive process of the plural sheets of paper, an information amount for each sheet of paper may become an enormous amount. Therefore, it may be difficult to determine how much the fixing temperature can be reduced, and if such a determination is can be carried out, a very large load may be required for the information processing.

Further, Patent Document 5 merely discloses a technology in which a fixing temperature is controlled depending on an image area for a case of fixing an output image onto a recording medium in which image a photograph image and a text image are mixed. Patent Document 5 is silent about a technology of carrying out temperature control for each sheet of paper during a successive process of plural sheets of paper.

In the technology of Patent Document 6, the same as in the technology of Patent Document 4, an information amount required for each sheet of paper may become an enormous amount, so it may be difficult to determine how much the fixing temperature can be reduced, and if such a determination can be carried out, a very large load may be required for the information processing.

SUMMARY OF THE INVENTION

According to an embodiment of the present invention, an image forming apparatus including a fixing unit configured to fix a not-yet-fixed image on a recording medium include a fixing target temperature changing part configured to change a fixing target temperature at a time of a fixing process; and a gradation processing part configured to carry out gradation processing on image information. For each sheet of a recording medium on which the fixing process is carried out, the fixing target temperature is changed based on whether halftone processing is carried out and a type of gradation processing to be used.

Other objects, features and advantages of the present invention will become more apparent from the following detailed description when read in conjunction with the accompanying drawings.

BRIEF DESCRIPTION OF THE DRAWINGS

FIG. 4 shows types of a dither method and specific examples of the number of lines for a photograph area and a character/letter area in each of image forming modes;

FIG. 6 shows a fixing target temperature to be selected according to a type of dithering and the number of lines in a case of using a dither method as a gradation processing method;

FIG. 7 shows fixing target temperatures for each of image forming modes according to a photograph area and a character/letter area, and whether a halftone image is included;

FIGS. 13A and 13B show fixing target temperatures for each of image forming modes according to a photograph area and a character/letter area, and whether a halftone image is included according to a fifth embodiment of the present invention;

DETAILED DESCRIPTION OF THE EMBODIMENTS

Figure 1:
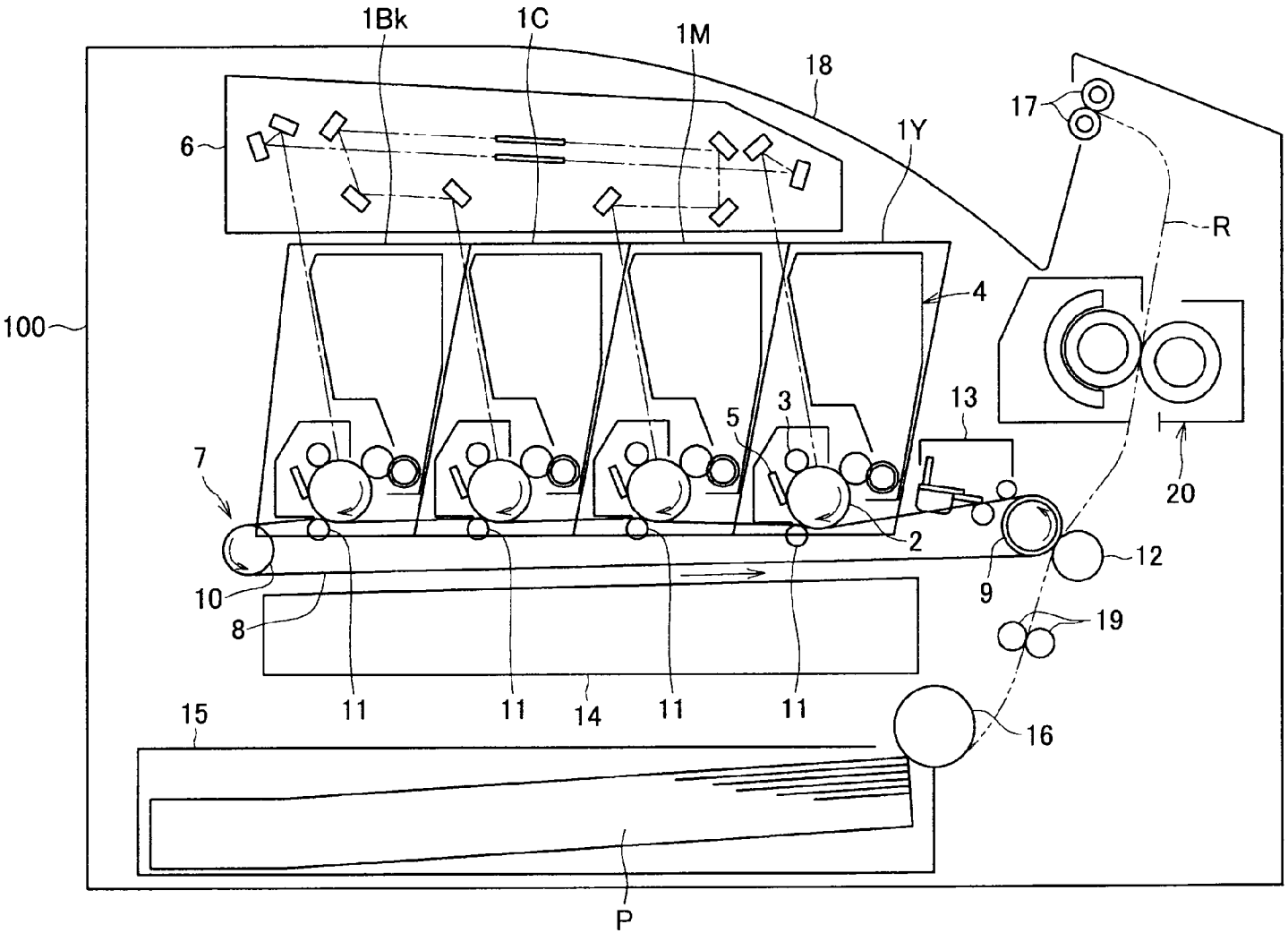
FIG. 1 is a general sectional view of a configuration of an image forming apparatus according to embodiments of the present invention.

An embodiment of the present invention has been devised in consideration of the above-mentioned situations in the related arts, and an object of the embodiment of the present invention is to provide an image forming apparatus by which an enormous information amount becomes not necessary, and it is possible to set an optimum fixing temperature for each page without selecting a specific mode.

According to a first aspect of the embodiment of the present invention, an image forming apparatus including a fixing unit configured to fix a not-yet-fixed image on a recording medium further includes a fixing target temperature changing part configured to change a fixing target temperature at a time of a fixing process; and a gradation processing part configured to carry out gradation processing on image information. For each sheet of a recording medium on which the fixing process is carried out, the fixing target temperature is changed based on whether halftone processing is carried out and a type of gradation processing to be used.

Thereby, it is possible to set the fixing target temperature at the time of fixing process for each sheet of a recording medium only by obtaining information as to whether halftone processing is carried out and a type of gradation processing to be used, without needing an enormous information amount and without selecting a specific mode.

According to a second aspect of the embodiment of the present invention, in the above-mentioned image forming apparatus according to the first aspect, the gradation processing part uses a dither method as a type of the gradation processing, and in a case where the type of the gradation processing to be used is the dither method, the fixing target temperature may be changed according to a type of the dither method and the number of lines in the dither method.

Thereby, it is possible to finely carry out fixing temperature control by changing the fixing target temperature based on the type of the dither method and the number of lines in the dither method in a case of using the dither method as the gradation processing.

According to a third aspect of the embodiment of the present invention, the above-mentioned image forming apparatus according to the second aspect may carry out copy output of outputting image information read from an original image and printer output of outputting an image information received from an external apparatus, and in a case of the copy output, the gradation processing according to an error diffusion method is carried out and in a case of the printer output, the gradation processing according to the dither method is carried out.

According to a fourth aspect of the embodiment of the present invention, in the above-mentioned image forming apparatus according to the third aspect, in a case where the gradation processing according to the dither method is used, the fixing target temperature is set lower in comparison to the case where the gradation processing according to the error diffusion method is used.

In the case where the error diffusion method is used as the halftone processing, most of toner on a recording medium is in a form of isolated small points (dots). Therefore, the toner may be removed after the printing unless fixing has been carried out at a sufficiently high temperature. In contrast thereto, in the case where the dither method is used, the amount of toner in a form of isolated dots is smaller in comparison to the case where the error diffusion method is used. Therefore, in the case where the gradation processing is carried out according to the dither method, the fixing target temperature may be reduced in comparison to the case of the gradation processing according to the error diffusion method is used.

According to a fifth aspect of the embodiment of the present invention, the above-mentioned image forming apparatus according to any one of the second through fourth aspects may have plural image forming modes in which it is possible to change at least one of resolution of an image to be fixed onto a recording medium and the number of levels of image dot diameter, and the type of the dither method and the number of lines may be changed according to the selected image forming mode.

According to a sixth aspect of the present invention, in the image forming apparatus according to the fifth aspect, an area detection part may be provided and configured to detect a character/letter area and a photograph area in an image of each sheet of recording medium, and the type and the number of lines may be changed according to the detection result of the area detection part.

According to a seventh aspect of the present invention, in the image forming apparatus according to any one of the first through sixth aspects, a timing of starting a change of the fixing target temperature for a recording medium for which a fixing process is to be carried out next, from the fixing target temperature for a specific recording medium, from among plural sheets of recording media, may be controlled according to a difference between the fixing target temperatures before and after the change of the fixing target temperature.

By being able to change the timing of starting a change of the fixing target temperature according to the difference in the fixing target temperatures before and after the change of the fixing target temperature, it is possible to control the fixing temperature at a desired temperature for each sheet of recording media which are being processed successively even in a case where the number of sheets of recording media to be processed per unit period of time is large. Thereby, it is possible to avoid an occurrence of a problem of cold offset or such otherwise occurring because the fixing temperature does not increase to timely follow the fixing target temperature. Further, it becomes not necessary to provide a waiting period of time for waiting for the fixing temperature being sufficiently increased, and thus, it is possible to switch the fixing temperature without reducing productivity (printing speed).

According to an eighth aspect of the embodiment of the present invention, in the image forming apparatus according to the seventh aspect, in a case where the fixing target temperature for the recording medium for which a fixing process is carried out next is higher than the fixing target temperature for the specific recording medium, the timing of starting the change in the fixing target temperature may be made earlier as the difference in the fixing target temperatures is larger.

Thereby, the increase in the fixing target temperature can be timely achieved for the fixing process of the next recording medium.

According to a ninth aspect of the embodiment of the present invention, in the image forming apparatus according to the seventh or eighth aspect, in a case where the fixing target temperature for the recording medium for which a fixing process is carried out next is higher than the fixing target temperature for the specific recording medium, the timing of starting the change in the fixing target temperature may be made earlier in comparison to the case where the fixing target temperature for the recording medium for which a fixing process is carried out next is lower than the fixing target temperature for the specific recording medium.

Thereby, it is possible to avoid a problem such as cold offset.

According to a tenth aspect of the embodiment of the present invention, in the image forming apparatus according to any one of the seventh through ninth aspects, in a case where the fixing target temperature for the recording medium for which a fixing process is carried out next is higher than the fixing target temperature for the specific recording medium, the change in the fixing target temperature may be started at a time when a first one of plural image forming units starts an image forming operation for the specific recording medium.

Thereby, it is possible to start the change of the fixing target temperature at an earlier timing, and thus, it is possible to avoid a problem such as cold offset.

According to an eleventh aspect of the embodiment of the present invention, in the image forming apparatus according to any one of the seventh through tenth aspects, in a case where the fixing target temperature for the recording medium for which a fixing process is carried out next is lower than the fixing target temperature for the specific recording medium, the change in the fixing target temperature may be carried out immediately after the specific recording medium has passed through the fixing unit.

In this case, there occurs no problem even when the fixing temperature has not been timely reduced to the fixing target temperature.

According to a twelfth aspect of the embodiment of the present invention, in the image forming apparatus according to any one of the first through eleventh aspects, the fixing unit may include a fixing member configured to fix the not-yet-fixed image on the recording medium to the recording medium; a pressing member configured to press the fixing member and form a fixing nip; and an induction heating part configured to carry out induction heating on the fixing member.

According to a thirteenth aspect of the embodiment of the present invention, in the image forming apparatus according to any one of the first through eleventh aspects, the fixing unit may include an endless fixing belt configured to fix the not-yet-fixed image on the recording medium to the recording medium; a supporting member configured to support an inner circumferential surface of the fixing belt; a heating member configured to heat the fixing belt; a pressing member configured to press the fixing belt from an outer circumferential surface thereof; and a nip creating part disposed on an inner circumferential side of the fixing belt and configured to come into contact with the pressing member via the fixing belt and create a nip.

According to a fourteenth aspect of the embodiment of the present invention, in the image forming apparatus according to any one of the first through eleventh aspects, the fixing unit may include a fixing member configured to fix the not-yet-fixed image on the recording medium to the recording medium; a pressing member configured to press the fixing member and create a fixing nip; and a heating member configured to heat at least one of the fixing member and the pressing member. The heating member may be configured by a surface-type heating member in which a resistor heating part is disposed in the inside of a deformable film-shaped member.

According to a fifteenth aspect of the embodiment of the present invention, the image forming apparatus according to any one of the first through fourteenth aspects may be a full-color image forming apparatus, a required fixing temperature for a black toner may be lower by equal to or more than 10° C. than a required fixing temperature for a color toner, the black toner may include at least a thermoplastic resin, and as the thermoplastic resins at least crystalline polyester resin and non-crystalline polyester resin, a wax and a colorant.

According to the embodiment of the present invention, information to be obtained for controlling the fixing target temperature is only information as to whether halftone processing is used and information of a type of gradation processing to be used. Therefore, it is possible to set the optimum fixing target temperature (for a fixing process) for each sheet of recording medium during successive printing without need of an enormous information amount and without selecting a specific mode. Thus, it is possible to provide an image forming apparatus matching a recent trend of saving energy and shortening a required starting-up period of time.

Below, based on drawings, embodiments of the present invention will be described. It is noted that in respective drawings illustrating the embodiments, the same reference numerals are given, as long as identification is possible, to members or parts/components having the same functions or shapes, and duplicate description thereof will be omitted.

First, with reference to FIG. 1, the entire configuration and operations of an image forming apparatus according to the embodiments of the present invention will be described.

The image forming apparatus shown in FIG. 1 is a color laser printer, and an apparatus body thereof 100 includes four process units 1Y, 1M, 1C and 1Bk as image forming units which are detachably loaded. The respective process units 1Y, 1M, 1C and 1Bk have the same configuration except where toners of different colors of yellow (Y), magenta (M), cyan (C) and black (Bk) corresponding to color separation components for a color image are held there, respectively.

Specifically, each of the process units 1Y, 1M, 1C and 1Bk includes a photosensitive member 2 having a drum-like shape and acting as an image carrying member; an electrification unit including an electrification roller 3 electrifying a surface of the photosensitive member 2; a development unit 4 supplying a toner (developer) to the surface of the photosensitive member 2; and a cleaning unit including a photosensitive member cleaning blade 5 cleaning the surface of the photosensitive member 2. It is noted that in FIG. 1, the reference numerals are given only to the photosensitive member 2, the electrification roller 3, the development unit 4 and the cleaning blade 5 in the yellow process unit 1Y, and reference numeral in the other process units 1M, 1C and 1Bk are omitted.

In FIG. 1, above the respective process units 1Y, 1M, 1C and 1Bk, an exposure unit 6 acting as an exposing part exposing the surface of the photosensitive members 2 is disposed. The exposure unit 6 includes light sources, polygon mirrors, f-θ lenses, reflection mirrors and so forth, and irradiates light onto the surfaces of the respective photosensitive members 2 based on given image data.

Further, below the respective process units 1Y, 1M, 1C and 1Bk, a transfer unit 7 is disposed. The transfer unit 7 includes an intermediate transfer belt 8 made of an endless belt acting as a transfer member. The intermediate transfer belt 8 is wound on a driving roller 9 and a driven roller 10 acting as supporting members, and is configured to run to circulate in a direction indicated by an arrow as a result of the driving roller 9 being rotated counterclockwise.

At respective positions facing the four photosensitive members 2, four primary transfer rollers 11 are disposed. The respective primary transfer rollers 11 are pressed onto an inner circumferential surface of the intermediate transfer belt 8 at respective positions, and primary nips are created at the positions where areas of the intermediate transfer belt 8 being thus pressed come into contact with the respective photosensitive members 2, respectively. The respective primary transfer rollers 11 are connected to a power source (not shown), and a certain direct-current voltage (DC) and/or alternate-current voltage (AC) is applied to the primary transfer rollers 11.

Further, a secondary transfer roller 12 acting as a secondary transfer part is disposed at a position facing the driving roller 9. The secondary transfer roller 12 is pressed onto an outer circumferential surface of the intermediate transfer belt 8, and a secondary nip is created at a position where the secondary transfer roller 12 comes into contact with the intermediate transfer belt 8. The secondary transfer roller 12 is connected to a power source (not shown), the same as the primary transfer rollers 11, and a certain direct-current voltage (DC) and/or alternate-current voltage (AC) is applied to the secondary transfer roller 12.

Further, on the outer circumferential surface at a right side end of the intermediate transfer belt 8 in FIG. 1, a belt cleaning unit 13 is disposed to clean the surface of the intermediate transfer belt 8. A waste toner transport hose (not shown) extending from the belt cleaning unit 13 is connected to an inlet part of a waste toner container 14 disposed below the transfer unit 7.

Below the apparatus body 100, a paper supply cassette 15 is disposed and holds sheet-shaped recording media P such as paper, OHP sheets or such. In the paper supply cassette 15, a paper supply roller 16 is provided for feeding out the held recording media P, sheet by sheet. Above the apparatus body 100, a pair of paper ejection rollers 17 for ejecting recording media, sheet by sheet, externally and a paper ejection tray 18 for stocking the ejected recording media.

In the apparatus body 100, a conveyance path R is disposed for conveying a recording medium P from the paper supply cassette 15 to the paper ejection tray 18 via the secondary nip. In the conveyance path R, a pair of registration rollers 19 are disposed on a recording-medium-conveyance-direction upstream side with respect to the positron of the secondary transfer roller 12. A fixing unit 20 is disposed on a recording-medium-conveyance-direction downstream side with respect to the position of the secondary transfer roller 12.

Below, with reference to FIG. 1, basic operations of the above-mentioned image forming apparatus will be described.

When image forming operations are started, the photosensitive members 2 of the respective process units 1Y, 1M, 1C and 1Bk are rotated clockwise, and the surfaces of the photosensitive members 2 are uniformly electrified to a certain polarity by the electrification rollers 3, respectively. Based on image information (image data) of an original image read by a reading unit (not shown), laser light is emitted by the exposure unit 6 to the electrified surfaces of the respective photosensitive members 2, and electrostatic latent images are formed on the surfaces of the respective photosensitive members 2. At this time, the image information for exposing the respective photosensitive members 2 includes image information of respective single colors obtained from decomposing (separating) a desired full-color image into respective sets of color information of yellow, magenta, cyan and black. Toners are supplied by the respective development units 4 to the electrostatic latent images thus formed on the photosensitive members 2, and thus, the electrostatic latent images are visualized into toner images.

The driving roller 9 on which the intermediate transfer belt 8 is wound is driven and rotated, and thus, the intermediate transfer belt 8 is caused to run to circulate in the direction of the arrow. Further, a constant voltage or a voltage controlled by a constant current at a polarity reverse to the electrified polarity of the toner is applied to the respective primary transfer rollers 11, and thereby, transfer electric fields are created at primary nips between the respective primary transfer rollers 11 and the respective photosensitive members 2. Then, the toner images of the respective colors on the respective photosensitive members 2 are superposed onto the intermediate transfer belt 8 in sequence by the transfer electric fields created at the primary transfer nips. Thus, the intermediate transfer belt 8 has a thus-obtained full-color toner image on the surface thereof. Further, toners on the respective photosensitive members 2 not having been transferred to the intermediate transfer belt 8 are removed by the cleaning blades 5.

Further, when the image forming operations are started, the paper supply roller 16 is rotated, and the recording media P are conveyed, sheet by sheet, from the paper supply cassette 15. The thus-conveyed recording medium P is sent to the secondary transfer nip between the secondary transfer roller 12 and the intermediate transfer belt 8 and the timing thereof is determined by the registration roller 19. At this time, to the secondary transfer belt 12, a transfer voltage having the polarity reverse to the electrification polarity of the toner image on the intermediate transfer belt 8 is applied, and thereby, a transfer electric field is created at the secondary transfer nip. Then, by means of the transfer electric field created at the secondary transfer nip, the toner image on the intermediate transfer belt 8 is transferred to the recording medium P in a lump. After that, the recording medium P is sent to the fixing unit 20, and the toner image is fixed onto the recording medium P there. Then, the recording medium P is ejected to the paper ejection tray 18 by means of the pair of the paper ejection rollers 17.

Thus, the image forming operations for forming the full-color image on the recording medium have been described. However, it is also possible to form a single-color image by using any one of the four process units 1Y, 1M, 1C and 1Bk, or form a two-color or three-color image by using two or three of the process units.

Next, with reference to FIG. 2, a configuration and operations of the above-mentioned fixing unit 20 will be described.

The fixing unit 20 includes a fixing sleeve 22 as a fixing member fixing a not-yet-fixed image T on the recording medium P; a fixing roller 21 as a supporting member supporting the fixing sleeve 22; an induction heating part 30 as a heating member heating the fixing sleeve 22; and a pressing roller 23 as a pressing member pressing the fixing sleeve 22.

The fixing sleeve 22 is obtained from forming, on a base layer made of a metal material having a thickness of 30 through 50 μm, an elastic layer and a releasing layer in sequence, and has an outer diameter of 40 mm. As a material of the base layer of the fixing sleeve 22, a magnetic metal material such as iron, cobalt, nickel, or an alloy thereof may be used. The elastic layer of the fixing sleeve 22 is made of an elastic material such as silicone rubber, and has a thickness of 150 μm. Thereby, heat capacity is not so much, and it is possible to obtain a satisfactorily fixed image having no fixing unevenness. Further, the releasing layer of the fixing sleeve 22 is formed as a result of a fluorine compound such as PFA being coated to have a tube-like shape, and has a thickness of 50 μm. The releasing layer is provided for the purpose of providing toner releasing performance on the surface of the fixing sleeve 22 that directly comes into contact with the toner image (toner) T.

The fixing roller 21 is formed as a result of forming a heat-resistant elastic layer 21*b* made of a silicone foam on a cylindrical core metal 21*a* made of a metal material such as stainless steal, and has an outer diameter of approximately 40 mm. The elastic layer 21*b* of the fixing roller 21 has a radial thickness of 9 mm, and is formed to have Asker C hardness on its axis of 30 through 50 degrees. The fixing roller 21 comes into contact with the inner circumferential surface of the fixing sleeve 22, and maintains the fixing sleeve 22 of a thin thickness to have a roller-like shape.

The pressing roller 23 is formed as a result of forming a heat-resistant elastic layer 23*b* made of a silicone rubber or such and a releasing layer (not shown) in sequence on a core metal 23*a* made of a highly thermal conductive metal material such as aluminium or copper, and has an outer diameter of 40 mm. The elastic layer 23*b* is formed to have a radial thickness of 2 mm. The releasing layer is formed as a result of coating a PFA tube, and is formed to have a thickness of 50 μm. The pressing roller 23 is pressed onto the fixing roller 21 via the fixing sleeve 22, and forms a nip part at the point of thus being pressed. The recording medium P is conveyed to the nip part.

The induction heating part 30 includes an exciting coil 31, a core part 32 and a demagnetizing coil 33. The exciting coil 31 is formed as a result of a litz wire in which fine wires are bound being wound on a coil guide disposed to cover a part of the outer circumferential surface of the fixing sleeve 22 to extend along a width direction (i.e., a direction perpendicular to the drawing of FIG. 2). The demagnetizing coil 33 is disposed symmetrically to have a physical relationship corresponding to a recording-medium-width direction and is disposed to be superposed on the exciting coil 31. The core part 32 is made of a ferromagnetic material (having relative permeability on the order of 2500) such as ferrite, and has a center core 32*b* and a side core 32*a* provided to form efficient magnetic fluxes toward the fixing sleeve 22. The core part 32 is disposed to face the exiting coil 31 extending in the width direction.

Figure 2:
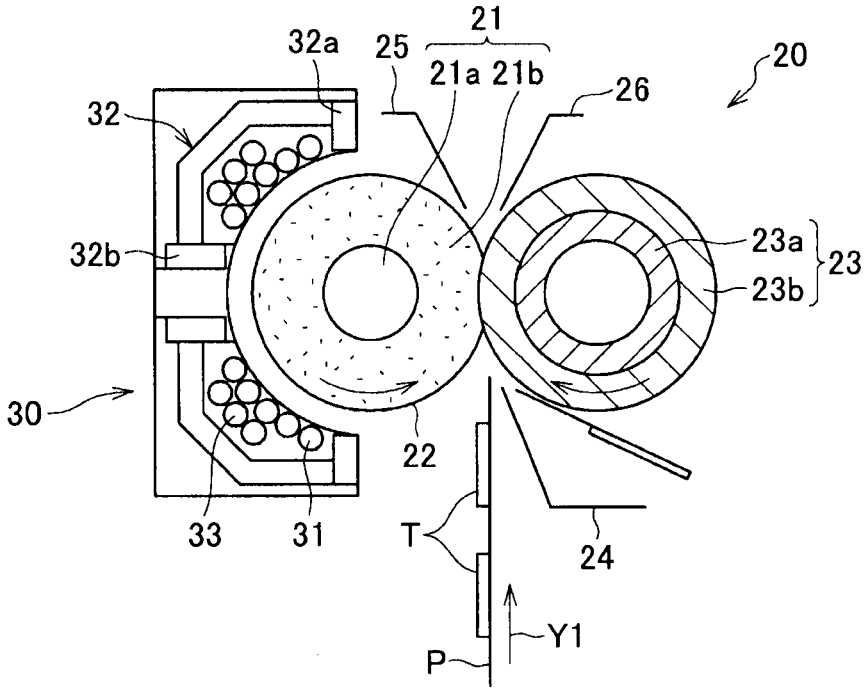
FIG. 2 is a general sectional view of a configuration of a fixing unit mounted in the image forming apparatus.

The fixing unit 20 configured as described above operates as follows:

By a driving motor (not shown), the pressing roller 23 is driven and rotated clockwise in FIG. 2, and then, the fixing sleeve 22 is driven and rotated counterclockwise. At this time, the fixing roller 21 supporting the fixing sleeve 22 is not positively driven and rotated. Then, the fixing sleeve 22 acting as a heating member and a fixing member is heated by the magnetic fluxes generated by the induction heating part 30 at a position facing the induction heating part 30.

In detail, a high-frequency alternating electric current of 10 kHz through 1 MHz (preferably, 20 kHz through 800 kHz) is flown in the exciting coil 31 by a power source part (not shown), and thereby magnetic lines of force are formed near the fixing sleeve 22 facing the exciting coil 31 and switched alternately between both directions. As a result of the alternating magnetic field thus being formed, eddy currents are generated in the base (heating layer) of the fixing sleeve 22, Joule heat is generated through the electric resistance of the base, and thus induction heating of the base is carried out.

Thus, the fixing sleeve 22 is heated through induction heating of the base thereof.

The surface of the fixing sleeve 22 heated through the induction heating reaches the nip part between the fixing sleeve 22 and the heating roller 23. Then, the not-yet-fixed toner image T (toner) on the recording medium P being conveyed is heated and melted.

In detail, the recording medium P carrying the toner image formed through the above-described image forming process is guided by a guide plate 24 and is sent to and inserted between the fixing sleeve 22 and the pressing roller 23 (as a result of the recording medium P moving in a conveyance direction indicated by an arrow Y1). Then, the toner image T is fixed to the recording medium P by the heat given by the fixing sleeve 22 and the pressure given by the pressing roller 23, and the recording medium P is sent out from the nip part as being separated from the fixing sleeve 22 by a fixing separation plate 25 and a pressing separation plate 26. The surface of the fixing sleeve 22 thus having passed through the nip part then reaches at the position facing the induction heating part 30 again.

Thus, the entire configurations and operations of the image forming apparatus and the fixing unit according to the embodiments of the present invention have been described.

Below, a feature of a first embodiment of the present invention will be described.

First, a configuration and operations of the first embodiment will be described.

A control part such as a CPU mounted in the image forming apparatus according to the first embodiment of the present invention acts as a gradation processing part carrying out gradation processing on image information, and a fixing temperature changing part changing a fixing target temperature at a time of a fixing process. "A fixing target temperature at a time of a fixing process" means a fixing target temperature at a time when the recording medium is passing through the fixing nip (i.e., the recording medium is passing or the plural recording media are successively passing through the fixing nip), from when the supply of the recording medium is started to when the supply of the recording medium is finished, and does not mean a starting-up temperature or such to which the fixing member is heated before the supply of the recording medium is started.

According to the first embodiment, as the gradation processing, two types, i.e., a dither method and an error diffusion method, are used. The dither method is a method where a gradation image is expressed by two values (i.e., black and white). This method is similar to common binarization, and as a result of using the threshold of the binarization which is changed appropriately, it can be seen when viewed from a distance as if gradation between black and white exists although it is binary. On the other hand, the error diffusion method is such a type of method of smoothly expressing an image through halftone processing. In this method, an error occurring from processing of a pixel of a digital image is assigned to peripheral pixels, after that the processing is continued also considering an influence of the error having been assigned, and thus, the error is minimized as a whole.

Further, according to the first embodiment, the fixing target temperature is set at three levels, and the fixing temperature changing part selects a temperature at any one of the three levels. Usually, the setting of the fixing target temperature is carried out where the fixing target temperature is set to a value such that no problem such as a fixing failure occurs even for a case where such a type of an image which is most disadvantageous for being fixed onto a recording medium is fixed onto a recording medium, as long as the type of the recording medium is not changed. The fixing target temperature that is set in a case of the most disadvantageous type of an image is set as a normal temperature (first fixing target temperature). Further, the fixing target temperature slightly reduced from the normal temperature is set as a level 1 temperature (second fixing target temperature), and the fixing target temperature considerably reduced from the normal temperature is set as a level 2 temperature (third fixing target temperature). For example, the level 1 temperature is set lower than the normal temperature by 5° C., and the level 2 temperature is set lower than the normal temperature by 10° C.

Below, a controlling method for the fixing target temperature according to the first embodiment of the present invention will be described with reference to a flowchart of FIG. 3 in detail.

First, before a recording medium is sent to the fixing unit, it is determined whether halftone processing is to be carried out on an image to be formed on the recording medium (step S1). Whether halftone processing is to be carried out is determined using CMYK values. Specifically, when an image is printed from a personal computer, RGB values (0 through 100%) of a display device are converted into CMYK values (0 through 100%) through printer image processing, and rendering is carried out for each page through an engine. Whether halftone processing is to be carried out is determined from the thus-obtained CMYK values. In a case where it is determined that halftone processing is not to be carried out, for example, K=100%, it is possible to select the low fixing target temperature since the image is solid and is advantageous to the fixing performance. Therefore, in a case where it is determined that halftone processing is not to be carried out, the level 2 temperature considerably reduced from the normal temperature is selected (step S3).

On the other hand, in a case where it is determined that halftone processing is to be carried out, i.e., K=0 through 99%, the image is disadvantageous to the fixing performance, and thus it is not possible to reduce the fixing target temperature considerably. In this case, a further determination is carried out as to a type of gradation processing used for image forming (step S2). As a result, in a case where the error diffusion method is used as the halftone processing, most toner on the recording medium has a form of isolated small points (dots), and the toner may be removed after the printing unless the fixing onto the recording medium has been carried out at a sufficiently high temperature. Thus, since it is not possible to reduce the fixing target temperature in a case where it is determined that the type of the halftone processing is the error diffusion method, the normal temperature that is the usual fixing target temperature is selected (step S5).

On the other hand, in a case where the dither method is used, gradation is expressed by drawing lines, for example. Therefore, isolated dots of toner are fewer than those of the error diffusion method. However, this method is disadvantageous to the fixing performance in comparison to a case where no halftone processing is carried out. Therefore, in a case where it is determined that the dither method is used, the level 1 temperature is selected (step S4).

Thus, according to the first embodiment, selection of the fixing target temperature is thus carried out. In a case where printing is carried out on plural recording media successively, the above-described process of FIG. 3 is carried out for each sheet of the recording media, and the fixing target temperature is selected for each of the recording media.

A control method according to a second embodiment of the present invention will now be described.

According to the second embodiment, the gradation processing to use is changed between a case of carrying out printer output where image information received from an external apparatus such as a personal computer is output and a case of carrying out copy output where image information read from an original image is output through a copying function. Specifically, the dither method is used in a case of printer output, and the error diffusion method is used for a case of copy output. Further, in the case of printer output, plural image forming modes in which at least one of resolution of an image to be fixed onto a recording medium and the number of levels of size of image dot diameter depending on the purpose are prepared to be set. Specifically, a change of resolution of an image is carried out by changing the number of dots per unit area. For example, the number of dots per inch (dot density) is changed between 600 dpi, 1200 dpi, and so forth. A change of the number of levels of size of image dot diameter is carried out by changing the number of bits, by which bits the size (diameter) of each dot is expressed. According to the second embodiment, the image forming modes in printer output includes a speed-preferred general document mode; an image-quality-preferred general document mode; a photograph (image quality preferred) mode; and a high resolution mode. Resolution and the number of levels of size of image dot diameter are set as: 600 dpi and 1 bit for the speed-preferred general document mode; 600 dpi and 2 bits for the image-quality-preferred general document mode; 600 dpi and 4 bits for the photograph (image quality preferred) mode; and 1200 dpi and 1 bit for the high resolution mode.

The speed-preferred general document mode is a mode advantageous to productivity. Jagged shapes may be conspicuous in characters/letters or lines, because the number of lines is small, but a time required for image processing is short.

In the image-quality-preferred general document mode, a dispersion-type dithering is used for a character/letter area, and the number of lines is large in comparison to the speed-preferred general document mode. In this mode, in comparison to the speed-preferred general document mode, generation of jagged shapes of charters/letters is suppressed, line-screen-type dithering is used for a photograph area, and the mode is advantageous to color shading. However, since image quality is given priority, productivity (for example, a time required from when image data is input to when printing thereof is completed) is reduced in comparison to the speed-preferred general document mode.

The photograph mode is a mode in which the number of lines is larger for a photograph area than that of the image-quality-preferred general document mode, the image has higher resolution and graininess is improved.

The high resolution mode is a mode where the number of lines is larger than that of the photograph (image-quality-preferred) mode in each of a photograph area and a character/letter area, this mode has the highest resolution in the second embodiment and has sharpness of characters/letters or line drawings.

Switching between the respective modes is carried out by the user using a control panel provided on the apparatus body. Further, a paper type detection part that detects a type of paper (recording medium) may be provided, and switching between the respective modes may be carried out based on the detected type of paper.

Further, in the image forming apparatus according to the second embodiment, an area detection part is provided to detect a character/letter area and a photograph area of an image, and the type of the dither method and the number of lines are changed for each of the above-mentioned four image forming modes based on the detection result of the area detection part (whether a character/letter area or a photograph area). FIG. 4 shows the type (i.e., "concentration type", "line screen type" or "dispersion type") of the dither method and a specific example of the number of lines (150 [lpi], 200 [lpi], 250 [lpi], 300 [lpi] or 600 [lpi]) for each mode.

It is noted that it has been known that fixing performance (i.e, performance of fixing a toner image onto a recording medium) may not be satisfactory for a halftone image having the large number of isolated dots or such. Further, the fixing performance of a halftone image differs much depending on the type of the dither method to be used. Below, this point will be described.

Figure 5:
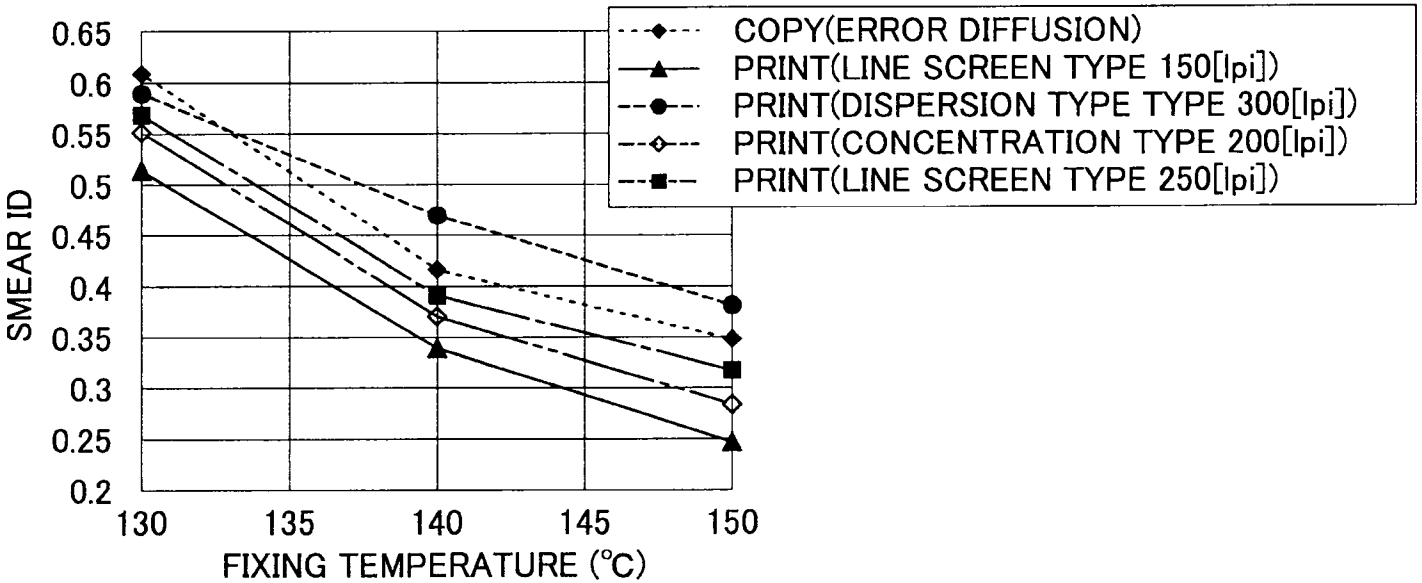
FIG. 5 shows fixing performance for a halftone image for each type of dithering.

FIG. 5 shows the fixing performance of a halftone image with respect to the respective types of dithering.

As a specific evaluation method, halftone images are output using respective types of the gradation processing method. At this time, 11 samples for different image densities of halftone images are prepared where the respective values of the 11 image densities (ID) include those from 0.5 through 1.0 in density in units of 0.05 therebetween measured by X-rite 938 made by X-Rite, Incorporated. As the fixing temperatures for the samples, three conditions, i.e., 130° C., 140° C. and 150° C. are prepared.

Then, smear fixing performance of each sample is evaluated. The smear fixing performance is one of fixing performance judgment method for copy/printer images, and a method of evaluating how easily toner is removed from a printed halftone image. A specific measuring method will be described now.

A halftone sample having a base density (ID) of 0.75±0.1 measured by a spectral densitometer made by X-Rite, Incorporated is rubbed 5 times in a going and returning manner by a white cotton cloth with a certain load, and the density of the white cotton cloth at which the toner adheres as a result is measured by the spectral densitometer. Then, it is determined that as the density on the white cotton cloth is higher, the toner is more easily removed, and the fixing performance is worse. At this time, the highest value of the smear ID value from among the samples of the same fixing temperature and the same image processing information is used as a smear ID value of the fixing performance in this gradation processing. The smear ID values of the fixing performance in the gradation processing are plotted for the various types of gradation processing with the ordinate of the smear ID value and the abscissa of the fixing temperature as shown in FIG. 5. In the graph of FIG. 5, the fact that the smear ID is larger means that the fixing performance is worse.

As can be seen from FIG. 5, in almost all of the types of dithering for printer output, the fixing performance is better than that of the error diffusion method for copy output. However, in the case of the dispersion-type dithering for printer output which is frequently used for characters/letters, the fixing performance is worse than that of the case of copy output. Thus, the result of the fixing performance cannot be determined simply from a single factor such as whether printing output is printer output or copy output. Therefore, it is preferable to carry out control of the fixing temperature to match the fixing performance of each of output images.

Therefore, in a control method for the fixing target temperature according to the second embodiment, in addition to the control flow the same as that of the first embodiment, the fixing target temperature is changed based on the type of dithering and the number of lines in a case where the dither method is used as gradation processing.

FIG. 6 shows the fixing target temperature to be selected according to the type of dithering and the number of lines in a case where the dither method is used as a gradation processing method, based on the study result from the graph of FIG. 5.

Here, the normal temperature and the level 1 temperature are the fixing target temperatures the same as those mentioned above. In the example shown in FIG. 6, in cases of a concentration-type dithering (using a concentration-type dither matrix) and a line-screen-type dithering (using a line screen-type dither matrix), setting is carried out in such a manner that up to the number of lines of 200 [lpi], the fixing target temperature is reduced to the level 1 temperature. Further, in a case of using a dispersion-type dithering (using a dispersion-type dither matrix), setting is carried out in such a manner that for the number of lines of 200 [lpi] or more, the fixing target temperature is not reduced from the normal temperature at any time.

FIG. 7 shows the fixing target temperatures for each of the image forming modes, with respect to a photograph area and a character/letter area, and whether a halftone image part is included, based on FIGS. 4 and 6.

It is noted that in FIG. 7, a case where no halftone image part is included is referred to as "including only a 100% image" (only solid image), and a case where a halftone image part is included is referred to as "including an image of less than 100%".

Below, with reference to FIG. 8 (flowchart), the control method for the fixing target temperature according to the second embodiment of the present invention will be described. It is noted that also in the second embodiment, the same as the above-mentioned first embodiment, the fixing target temperature is set to any one of the three levels, i.e., the normal temperature, the level 1 temperature and the level 2 temperature.

Figure 3:
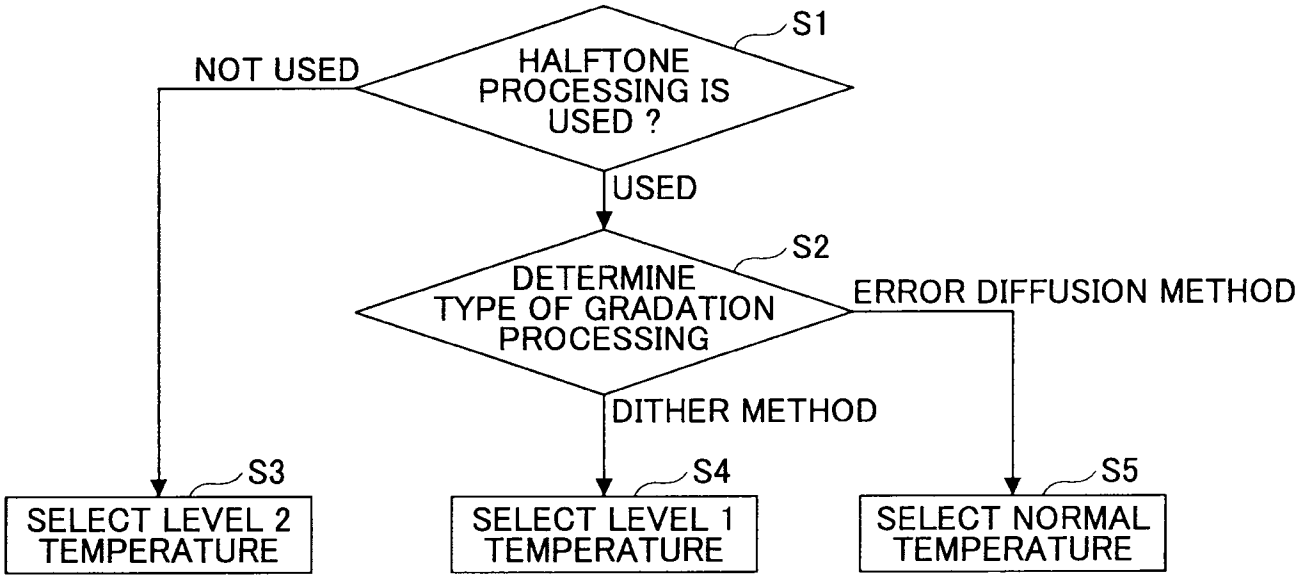
FIG. 3 is a flowchart illustrating a control method for a fixing target temperature according to the first embodiment of the present invention.
Figure 8:
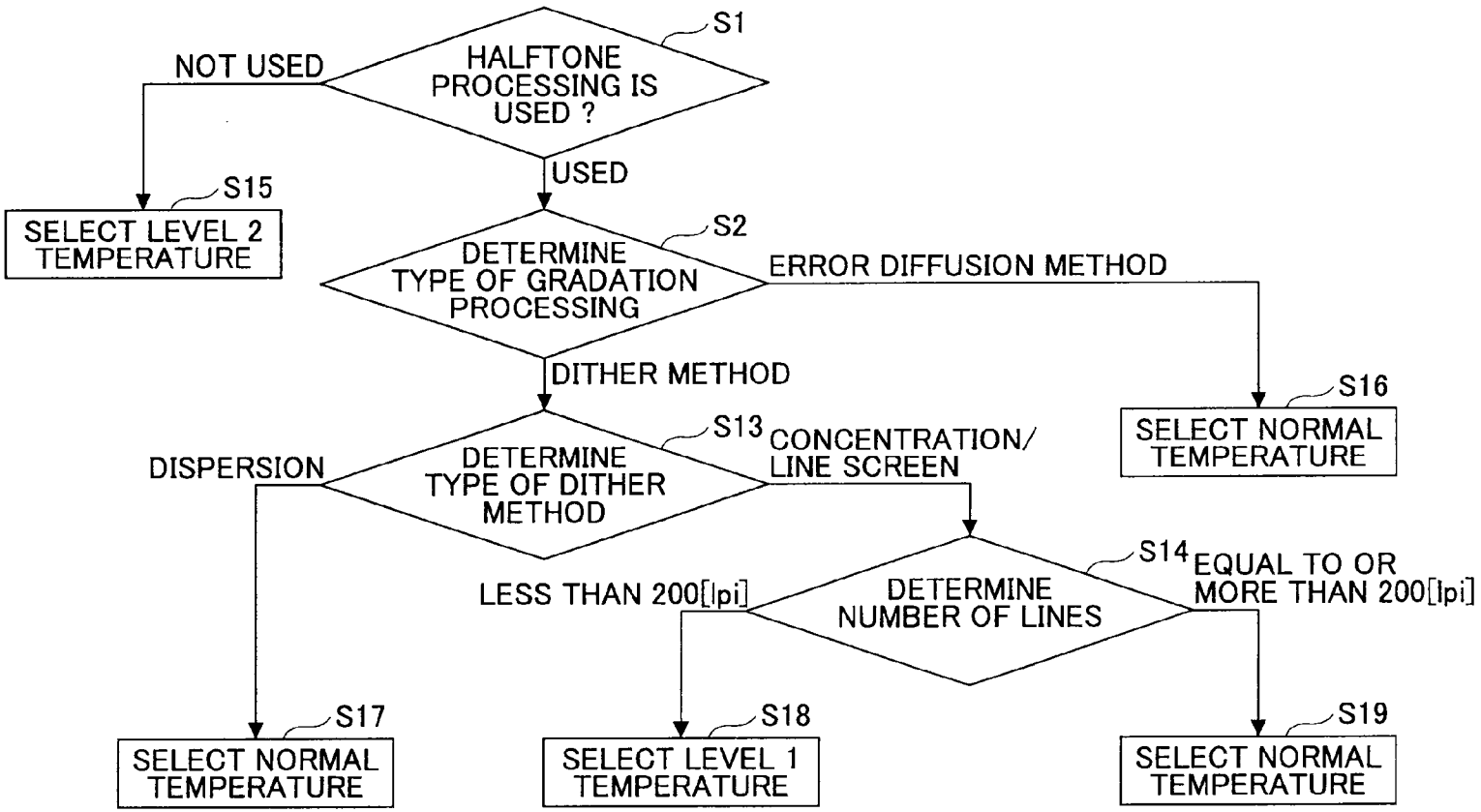
FIG. 8 is a flowchart illustrating a control method for a fixing target temperature according to a second embodiment of the present invention.

In FIG. 8, steps S1 and S2 are the same as steps S1 and S2 in the flowchart of FIG. 3 according to the first embodiment. Therefore, duplicate description therefor will be omitted, and only points different from the first embodiment will be described.

In a case where it is determined that the gradation processing type is the dither method, the type of the dither method is determined (step S13). As a result, in a case where it is determined that the dispersion-type dithering is used as the dither method, the normal temperature is selected (step S17) since the dispersion-type dithering is disadvantageous to the fixing performance in comparison to the other types of dithering (concentration-type dithering and line-screen-type dithering) even when the number of lines is the same, and thus, the fixing target temperature cannot be reduced.

On the other hand, in a case where it is determined that dithering (the concentration-type dithering or the line-screen-type dithering) other than the dispersion-type dithering is used, the number of lines is determined (step S14). As a result, in a case where it is determined that the number of lines is less than 200 [lpi], the level 1 temperature slightly reduced from the normal temperature is selected (step S18) since this case is relatively advantageous to the fixing performance. In contrast thereto, in a case where it is determined that the number of lines is equal to or more than 200 [lpi], the normal temperature is selected (step S19) since this case is disadvantageous to the fixing performance.

Thus, the control method for the fixing target temperature according to the second embodiment of the present invention has been described. Also in the second embodiment, in a case where printing is carried out on plural recording media successively, the above-described process of FIG. 8 is carried out for each sheet of the recording media, and the fixing target temperature is selected for each of the recording media.

Next, a control method according to a third embodiment of the present invention will be described.

According to the third embodiment, it is determined whether the formed image is a monochrome image or a color image, and also whether a character/letter area and/or a photograph area exist, and the fixing target temperature is selected.

Below, with reference to FIGS. 9 through 11 (flowcharts), the control method for the fixing target temperature according to the third embodiment will be described. It is noted that also in the third embodiment, the same as the above-mentioned respective embodiments, the fixing target temperature is set to any one of the normal temperature, the level 1 temperature and the level 2 temperature.

Figure 9:
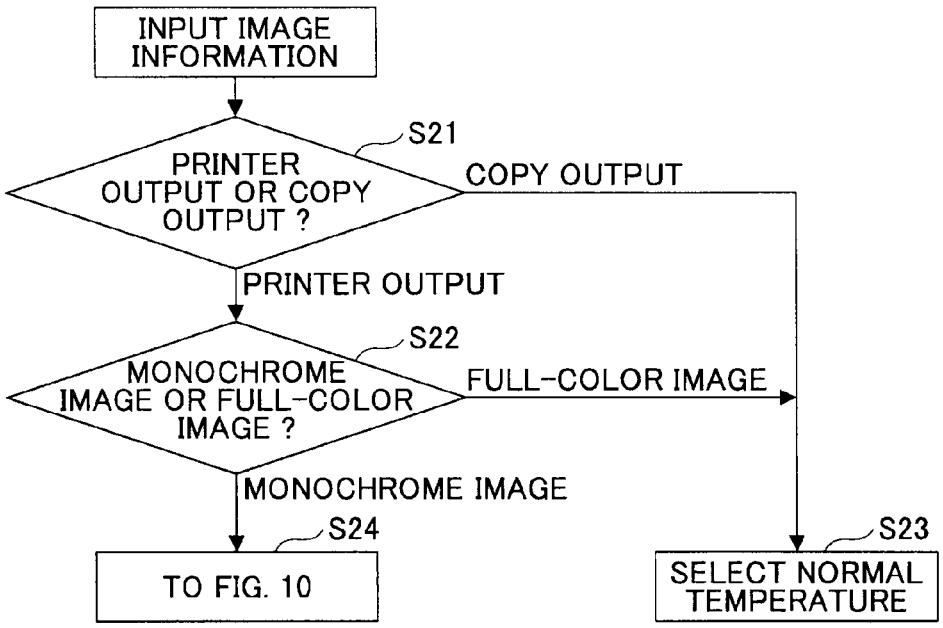
FIGS. 9, 10 and 11 are flowcharts illustrating a control method for a fixing target temperature according to a third embodiment of the present invention.

First, as shown in FIG. 9, it is determined whether the input image information is for printer output or copy output (step S21). Also in the third embodiment, the same as the above, the dither method is used in a case of printer output and the error diffusion method is used in a case of copy output. That is, the type of gradation processing is determined by determining whether the printer output or copy output is carried out. As a result, in a case where copy output is carried out, the error diffusion method is used, therefore it is not possible to reduce the fixing target temperature the same as the above, and the normal temperature is selected (step S23). It is noted that even in the case where the error diffusion method is used as a gradation processing method, it is also possible to carry out controlling of the fixing target temperature depending on sizes of dots and/or whether a halftone image part is included.

On the other hand, in a case where it is determined that printer output is carried out, further it is determined whether the image is a monochrome image or a color image (step S22). Since the dither method is used in a case of a monochrome image, it is then determined by obtaining image processing information 1 described next (see FIG. 10) whether it is possible to reduce the fixing target temperature from the normal temperature according to the type of the dithering and the number of lines. This is because the fixing target temperature of a monochrome is determined according to the smear fixing performance, and there is an image having the small number of isolated dots depending on the type of dithering such as the line-screen-type dithering, the concentration-type dithering or such. Therefore, the fixing target temperature may be able to be reduced in a case where the number of isolated dots is small and the image is advantageous to the smear fixing performance for halftone.

Further, the dither method is used as a gradation processing method also in the case of a full-color image. However, there is a likelihood that toners of equal to or more than two colors are superposed together in a case of a full-color image in comparison to a case of a monochrome image using a single color. Therefore, a toner adhesion amount is large and rather solid rendering performance or cold offset becomes a critical condition than the smear fixing performance, and thus, according to the third embodiment, the fixing target temperature is not reduced for full-color images. Accordingly, in a case where it is determined that the image is a full-color image, the normal target temperature is selected (step S23). It is possible to add a control of changing the fixing target temperature depending on a toner adhesion amount or such also in cases of full-color images.

Figure 10:
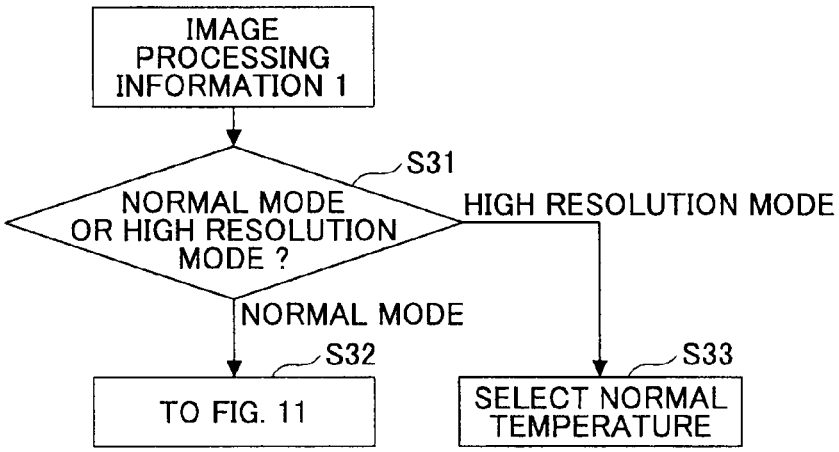

Next, in FIG. 10, in a case of a monochrome image (step S24), image processing information 1 is obtained, and it is determined whether it is possible to reduce the fixing target temperature from the normal temperature. This process will now be described.

As shown in FIG. 10, in this process, it is determined from the image processing information 1 whether the image is carried out in a normal mode or a high resolution mode (step S31). It is noted that the high resolution mode is the same as the above-mentioned high resolution mode and the normal mode means each of the above-mentioned respective modes other than the high resolution mode (i.e., the speed-preferred general document mode, the image-quality-preferred general document mode or the photograph mode (see FIG. 4)). Thus, the determination in step S31 is carried out according to which one of the above-mentioned four image forming modes is selected by the user, for example.

In a case where it is determined that the high resolution mode is used, the normal temperature is selected (step S33) since the number of lines is large in this case. It is noted that even in a case of the high resolution mode, such a control may be carried out that it is determined whether a halftone image part is included or so, and the fixing target temperature may be reduced in a case whether no halftone image part is included.

On the other hand, in a case of the normal mode, a determination is further carried out by obtaining image processing information 2 described next (see FIG. 11) because there is a likelihood of being able to reduce the fixing target temperature.

Figure 11:
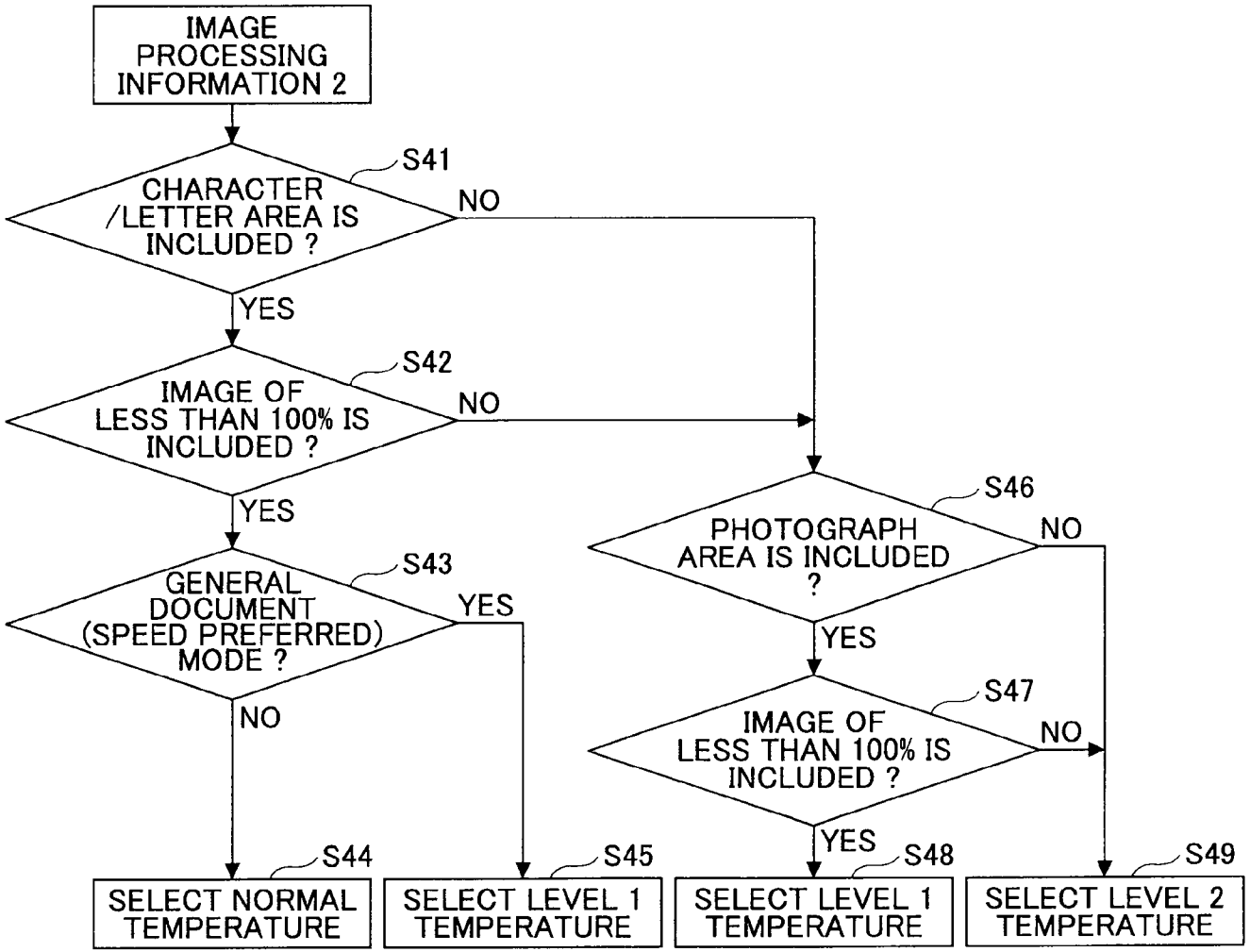

In FIG. 11, in a case of the normal mode (step S32 of FIG. 10), the image processing information 2 is obtained and it is determined whether the fixing target temperature can be reduced.

As shown in FIG. 11, in the process of FIG. 11, first it is determined whether a character/letter area exists (step S41). In a case where a character/letter area exists, it is determined whether the character/letter area includes an image of less than 100% (i.e., a halftone image part) (step S42). In a case where an image of less than 100% is included in the character/letter area, further it is determined whether the speed-preferred general document mode is used (step S43).

It is noted that in the case of the speed-preferred general document mode, the same as the above, the concentration-type dithering is used, and in a case of any one of the other image-quality-preferred general document mode and the photograph mode, the dispersion-type dithering is used for character/letter areas (see FIG. 4). Therefore, in a case where the image includes a character/letter area, the character/letter area includes an image of less than 100%, and the speed-preferred general document mode is used, the concentration-type dithering where there are few isolated dots is used. Therefore, in this case, the level 1 temperature is selected (step S45) since it is possible to somewhat reduce the fixing target temperature.

On the other hand, in a case where the image includes a character/letter area and the character/letter area has an image of less than 100% but an image forming mode other than the speed-preferred general document mode is used, the dispersion-type dithering disadvantageous to the fixing performance is used. Therefore, the fixing target temperature is not reduced and the normal temperature is selected (step S44).

Further, in a case where it is determined in step S41 that the image includes no character/letter area or it is determined in step S42 that a character/letter area does not include an image of less than 100%, it is determined (step S46) whether the image includes a photograph area. Then, in a case where it is determined that the image includes a photograph area, it is determined whether the photograph area includes an image of less than 100% (step S47). Then, in a case where the image includes a photograph area and the photograph area includes an image of less than 100%, the line-screen-type dithering may be used the same as the above (see FIG. 4). Therefore, there may be few isolated dots, and thus, it is possible to somewhat reduce the fixing target temperature. Therefore, the level 1 temperature is selected (step S48). In contrast thereto, in a case where it is determined in step S46 that the image includes no photograph area or it is determined in step S47 that a photograph area does not include an image of less than 100%, the level 2 temperature is selected (step S49). In this case, no halftone image exists, and thus, the image is a 100% solid image. Therefore, the margin for the fixing performance is large, and it is possible to considerably reduce the fixing target temperature. It is noted that as mentioned above, whether the image is a 100% solid image is determined from the CMYK values of the image. Thus, steps S42 and S47 of determining whether an image of less than 100% is included are carried out using the CMYK values of the image.

Thus, the control method for the fixing target temperature according to the third embodiment of the present invention has been described. Also in the third embodiment, in a case where printing is carried out on plural recording media successively, the above-described process of FIGS. 9 through 11 is carried out for each sheet of the recording media, and the fixing target temperature is selected for each of the recording media.

A low-temperature-fixing toner may be used as the black toner in any one of the above-mentioned embodiments of the present invention.

Below, a control method for the fixing target temperature according to a fourth embodiment of the present invention where a low-temperature-fixing black toner is used. Details of the toners used in the fourth embodiment will be described later.

Figure 12:
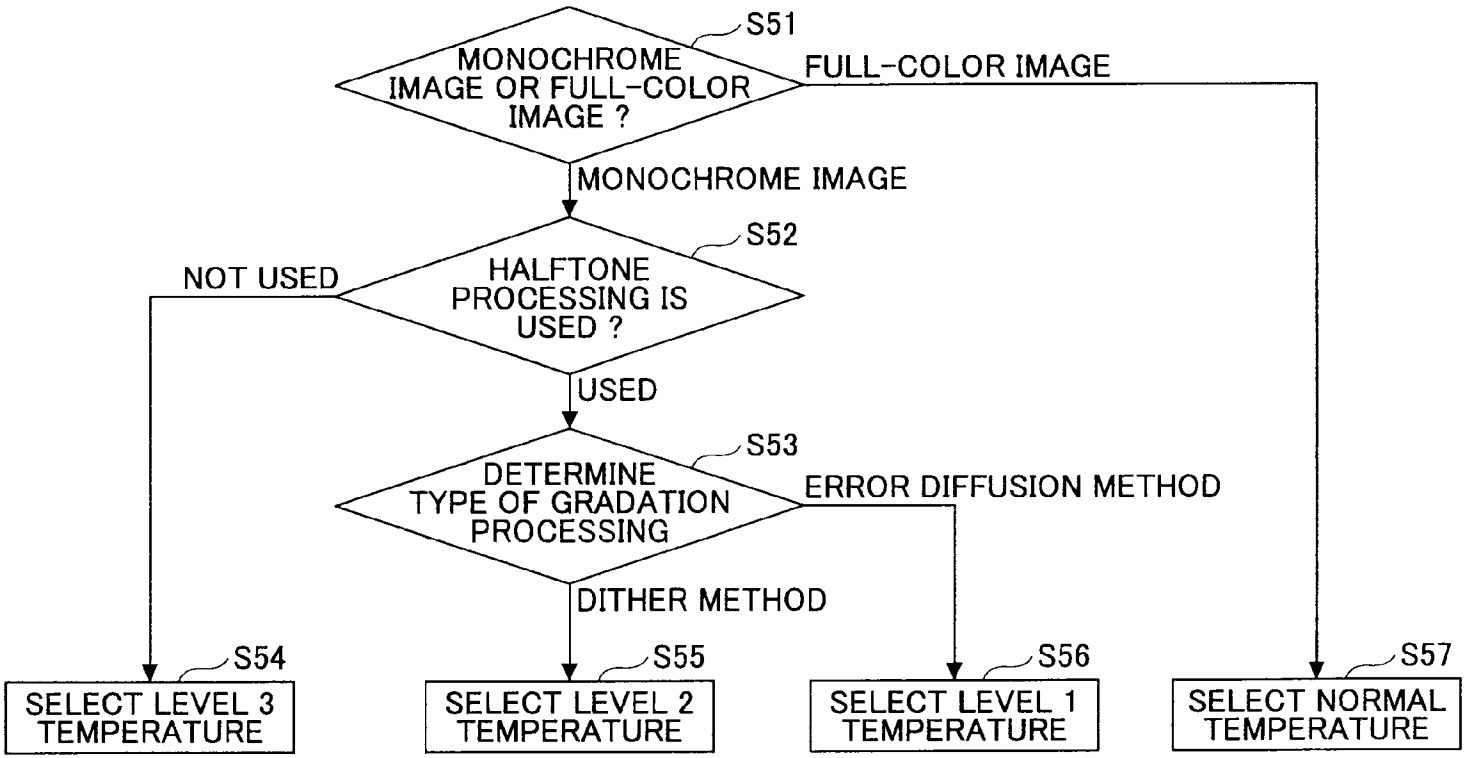
FIG. 12 is a flowchart illustrating a control method for a fixing target temperature according to a fourth embodiment of the present invention.

FIG. 12 is a flowchart of the control method for the fixing target temperature according to the fourth embodiment of the present invention.

In the fourth embodiment, the fixing target temperature is selected from four levels, and a fixing target temperature changing part selects any temperature of the four levels. Here, the fixing target temperature for a case of a full-color image which is most disadvantageous to the fixing performance is set as a normal temperature (first fixing target temperature). On the other hand, in a case of a monochrome image, it is possible to set the fixing target temperature lower than that of a case of a full-color image. Here, as the fixing target temperatures in a case of a monochrome image, a level 1 temperature (second fixing target temperature) slightly reduced from the normal temperature of a case of a full-color image; a level 2 temperature (third fixing target temperature) slightly reduced from the level 1 temperature; and a level 3 temperature (fourth fixing target temperature) considerably reduced from the level 1 temperature are prepared as the above-mentioned four levels. For example, the level 1 temperature is set to a temperature lower than the normal temperature by 10° C., the level 2 temperature is set to a temperature lower than the normal temperature by 15° C. and the level 3 temperature is set to a temperature lower than the normal temperature by 25° C.

As shown in FIG. 12, in the control of the fixing target temperature according to the fourth embodiment, first, it is determined (step S51) whether an image to be formed on a recording medium is a monochrome image or a full-color image. In a case of a full-color image, the normal temperature is selected as mentioned above (step S57). In contrast thereto, in a case of a monochrome image, a determination in step S52 is carried out since it is possible to reduce the fixing target temperature.

In step S52, it is determined whether halftone processing of the image is carried out. Further, depending on a result of the determination, after that (step S53) the type of gradation processing used in image forming may be determined. The operations in steps S52 and S53 are the same as those in step S1 and S2 in FIG. 3, and thus, duplicate description will be omitted. However, the fourth embodiment shown in FIG. 12 is different in that the normal temperature, the level 1 temperature and the level 2 temperature selected as results of steps S1 and S2 of FIG. 3 become the level 1 temperature, the level 2 temperature and the level 3 temperature, respectively, at a time of forming a monochrome image, as shown.

Next, a control method according to a fifth embodiment of the present invention using the low-temperature-fixing black toner will be described.

FIGS. 13A and 13B show the fixing target temperatures for each of the image forming modes at a time of printing full-color image (FIG. 13A) and at a time of printing a monochrome image (FIG. 13B) depending on a photograph area and a character/letter area, and whether a halftone image part is included (an image of less than 100% is included). It is noted that the normal temperature, the level 1 temperature, the level 2 temperature and the level 3 temperature in the fifth embodiment are the same as those in the fourth embodiment described above. Further, tables of FIGS. 13A and 13B are produced based on FIGS. 4 and 6, and settings of the types of dithering and the number of lines for the respective image forming modes in FIGS. 13A and 13B are the same as those mentioned above.

Figure 14:
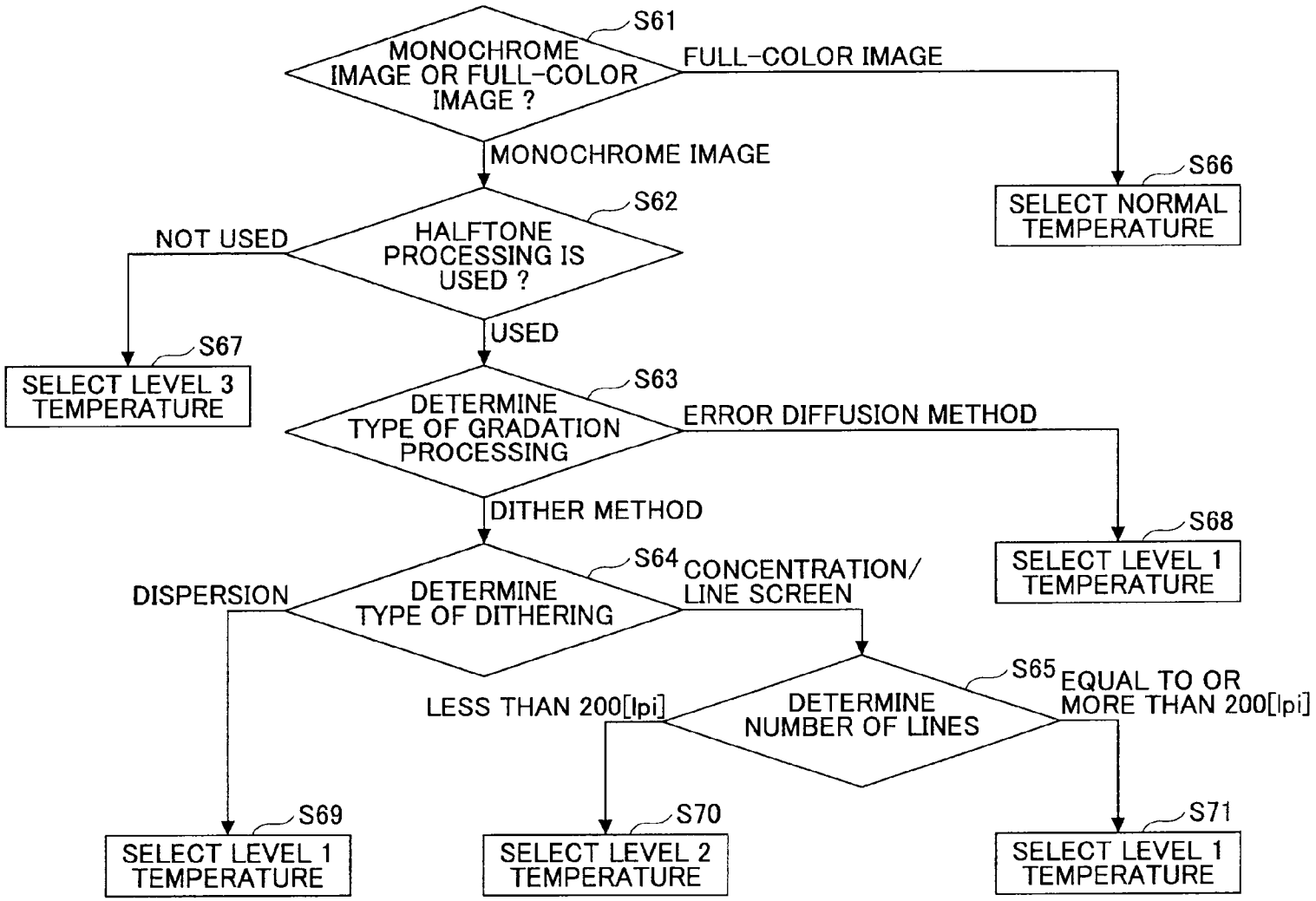
FIG. 14 is a flowchart illustrating a control method for a fixing target temperature according to the fifth embodiment of the present invention.

FIG. 14 is a flowchart of the control method according to the fifth embodiment of the present invention.

As shown in FIG. 14, in the control of the fixing target temperature according to the fifth embodiment, first it is determined in step S61 whether an image to be formed on a recording medium is a monochrome image or a full-color image. When the image is a full-color image, the normal temperature is selected as mentioned above (step S66). On the other hand, in a case of a monochrome image, determinations in steps starting from step S62 are carried out since it is possible to reduce the fixing target temperature.

It is noted that operations in steps S62, S63, S64 and S65 are the same as those in steps S1, S2, S13 and S14 in FIG. 8, and thus duplicate description will be omitted. However, the fifth embodiment shown in FIG. 14 is different in that the normal temperature, the level 1 temperature and the level 2 temperature selected as results of steps S1, S2, S13 and S14 of FIG. 8 become the level 1 temperature, the level 2 temperature and the level 3 temperature, respectively, at a time of forming a monochrome image.

Figure 15:
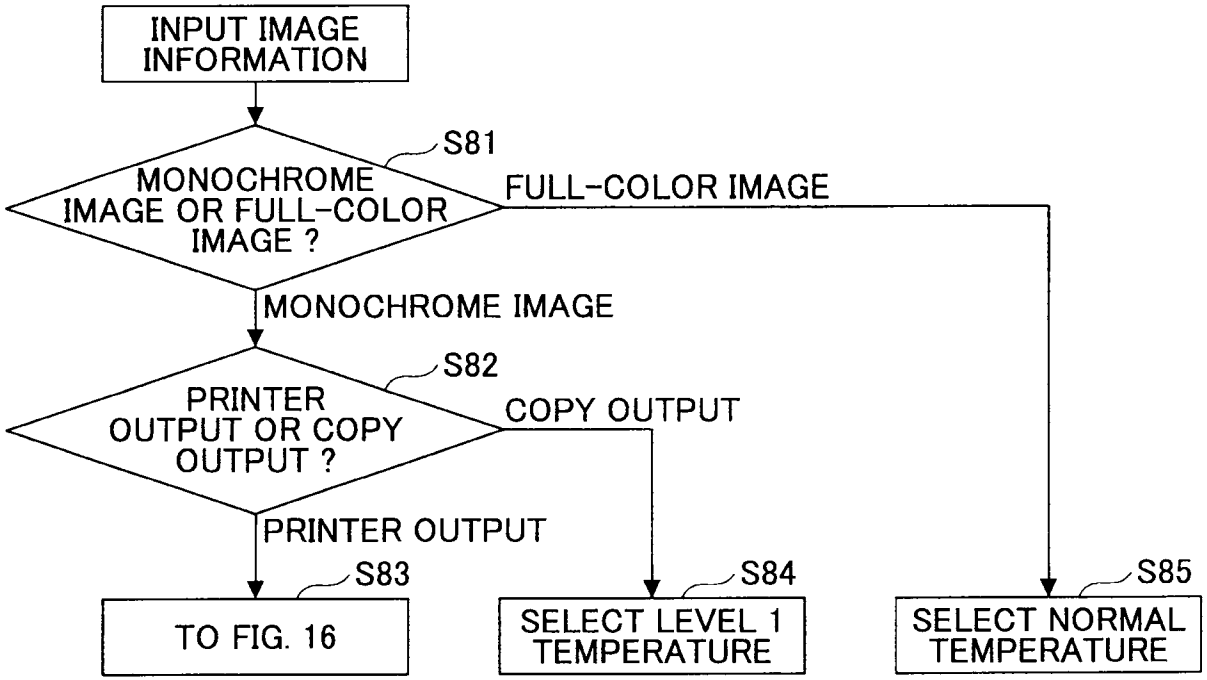
FIGS. 15, 16 and 17 are a flowchart illustrating a control method for a fixing target temperature according to a sixth embodiment of the present invention.
Figure 16:
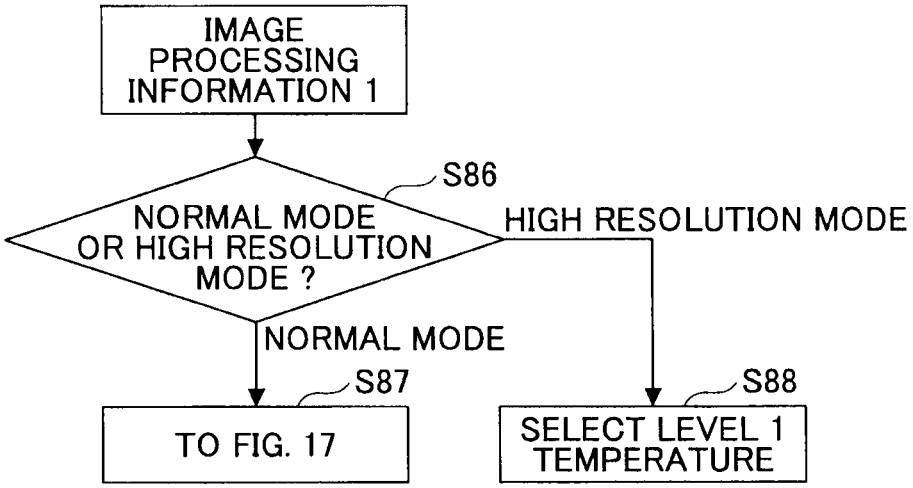
Figure 17:
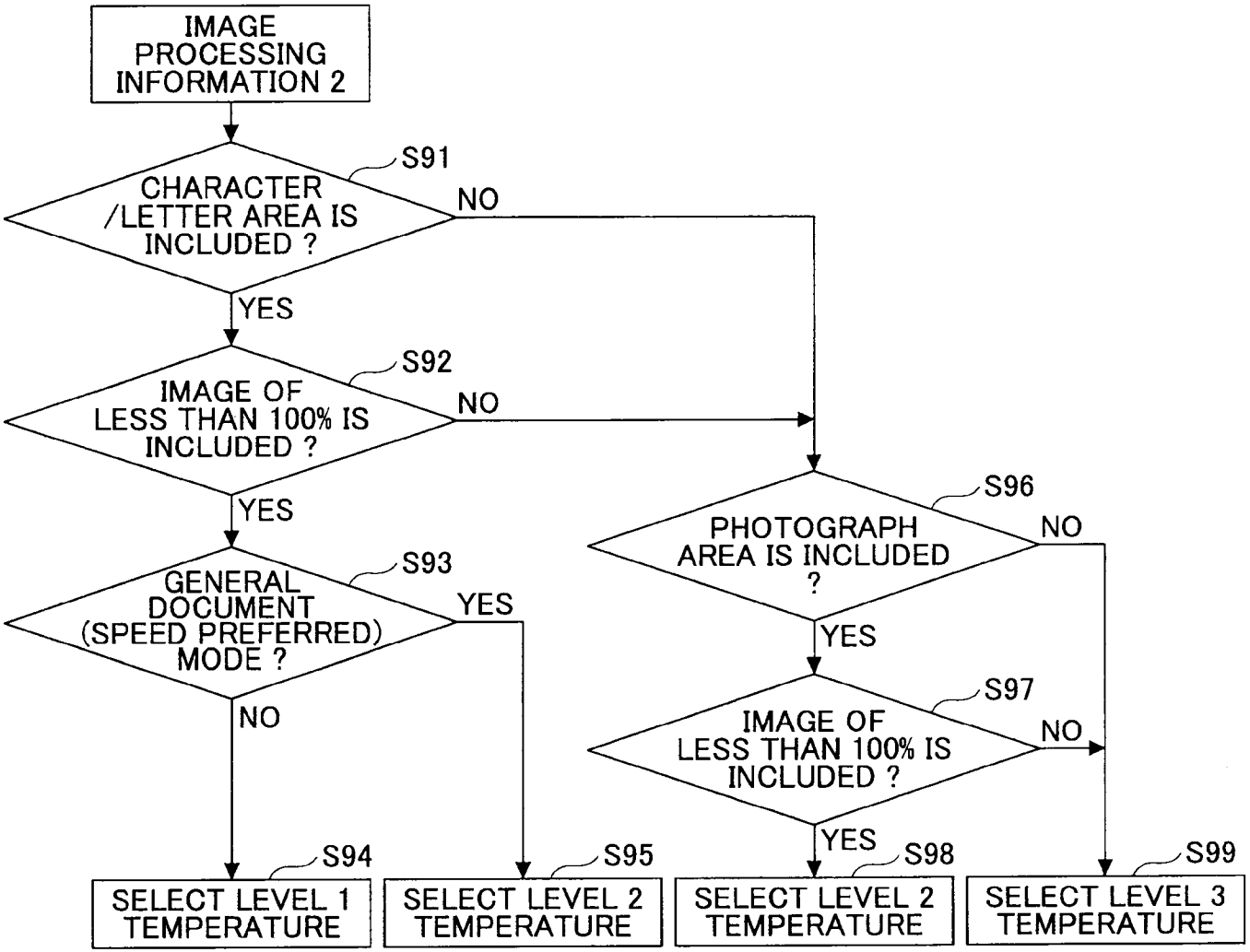

FIGS. 15, 16 and 17 are flowcharts of a control method according to a sixth embodiment of the present invention using the low-temperature-fixing black toner.

Also in the sixth embodiment, the same as the above-mentioned fourth and fifth embodiments, the fixing target temperature is selected from the different four levels, i.e., the normal temperature at a time of forming a full-color image and the level 1 temperature, the level 2 temperature and the level 3 temperature at a time of forming a monochrome image.

In the control of the fixing target temperature according to the sixth embodiment, first, as shown in FIG. 15, in step S81, it is determined whether an image to be formed on a recording medium is a monochrome image or a full-color image. In a case of a full-color image, the normal temperature is selected as mentioned above (step S85). On the other hand, in a case of a monochrome image, determinations starting from step S82 are carried out since it is possible to reduce the fixing target temperature.

In step S82, it is determined whether the input image information is for printer output or copy output. In a case where it is determined as copy output, the level 1 temperature is selected (step S84) since the error diffusion method is used and the fixing target temperature cannot be further reduced at a time of forming a monochrome image. It is note that it is possible to carry out control of the fixing target temperature according to the sizes of dots and/or whether a halftone image part is included even in the case of using the error diffusion method as a gradation processing method. On the other hand, in a case where it is determined as printer output, then a process (of FIG. 16) of obtaining image processing information 1 and determining whether the fixing target temperature can be reduced from the level 1 temperature is carried out (step S83).

FIG. 16 shows a flowchart of obtaining the image processing information 1 and selecting the fixing target temperature. FIG. 17 shows a flowchart of, after carrying out the process of FIG. 16, further obtaining image processing information 2, and selecting the fixing target temperature. The flowcharts of FIGS. 16 and 17 are the same as those shown in FIGS. 10 and 11, and duplicate description will be omitted. However, the sixth embodiment shown in FIGS. 16 and 17 is different in that the normal temperature, the level 1 temperature and the level 2 temperature selected in the flowcharts of FIGS. 10 and 11 become the level 1 temperature, the level 2 temperature and the level 3 temperature, respectively, at a time of forming a monochrome image.

Thus, the control methods for the fixing target temperature according to the fourth, fifth and sixth embodiments of the present invention using the low-temperature-fixing black toner have been described. Also in the these embodiments, in a case where printing is carried out on plural recording media successively, the above-described respective processes are carried out for each sheet of the recording media, and the fixing target temperature is selected for each of the recording media.

Below, a method of determining dithering according to an embodiment of the present invention will be described.

Figure 18:
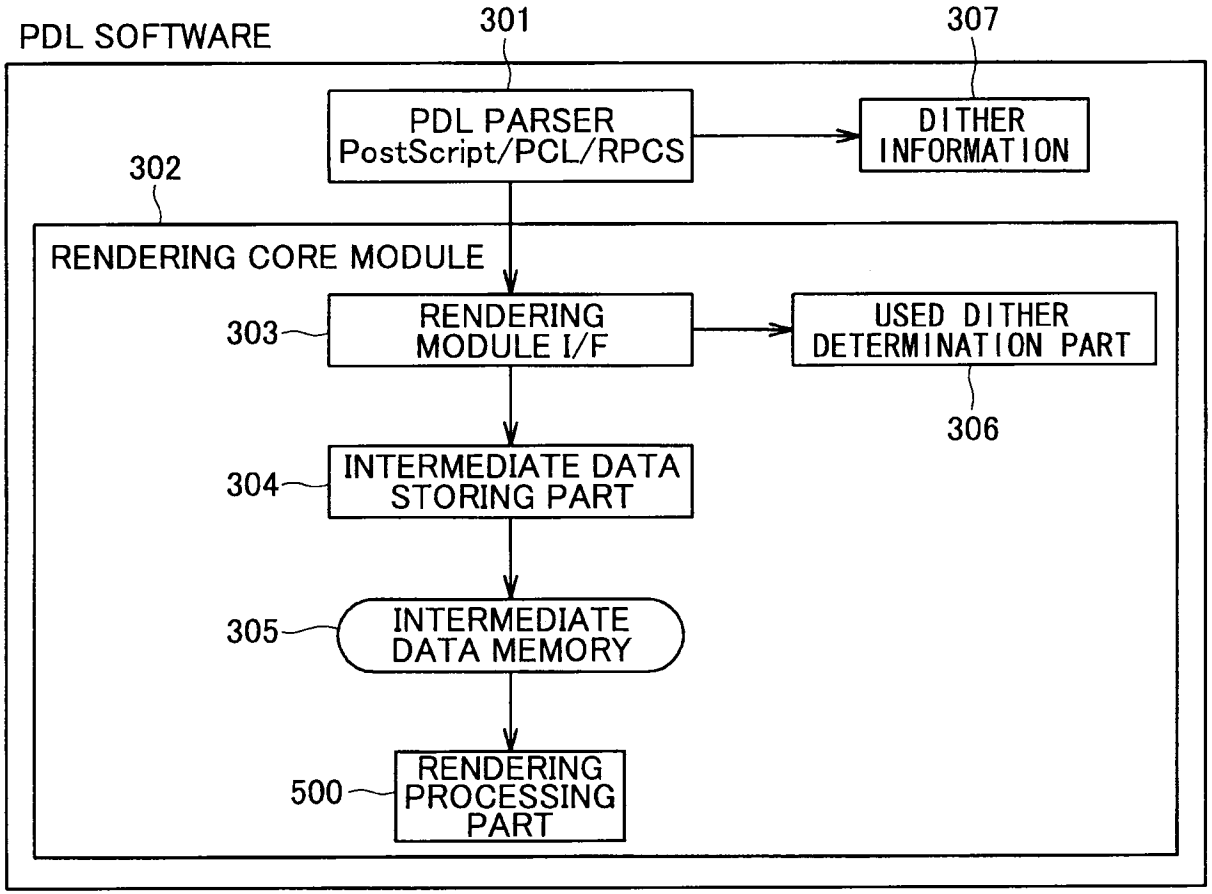
FIG. 18 shows PDL software.

FIG. 18 shows PDL software.

PDL software includes a parser part 301 carrying out syntax analysis (parsing) for each of PDL such as PS, PCL or RPCS of Ricoh; and a rendering core part 302 carrying out image forming of PDL. The rendering core part 302 includes a rendering module I/F part 303 that is an I/F receiving text, images, vector graphics and rendering setting information; an intermediate data storing part 304 storing rendering data such as text, images, vector graphics and so forth and the rendering setting information having colors and transparent settings in an intermediate data memory 305; the intermediate data memory 305; and plural rendering process parts 500 carrying out rendering based on the rendering data to generate output image data. Dither information 307 to be used is obtained by the PDL parser part 301 from an environment such as a ROM area or such at a time of starting up and is provided to the rendering core part 302.

With reference to FIG. 18, a method of controlling the fixing temperature for a certain page will now be described.

Printing data sent to a controller in the image forming apparatus from a driver of a host PC is data of each of jobs as units, one job includes one or more pages, and 1 page includes one or more bands. In the job, rendering commands and information used for various sorts of settings are included. Typical rendering commands include characters/letters, graphics and images. Further, also commands used for setting rendering colors, commands used for setting resolution of a page or such are included in the rendering commands. When receiving printing data, the PDL parser 301 separates the printing data into the rendering commands and so forth, and transfers them to the rendering module I/F 303. A used dither determination part 306 receives the information from the rendering module I/F 303, and selects dither IDs from among the dither information 307 previously obtained as mentioned above to be used in this environment, for being to be used for a page, based on depths, resolutions and other settings of the page. Next, rendering colors are set, and a rendering command I/F (not shown) included in the rendering module I/F 303 is called. Then, dithering to be used for coordinates at which rendering is carried out according to the rendering commands is determined up to planes and density values. The used dither determination part 306 may be included in the rendering module 303. When the dither IDs, planes and density values are thus determined, the fixing temperature information is also determined, and thus, the fixing temperature information for the rendering commands is obtained.

Figure 19:
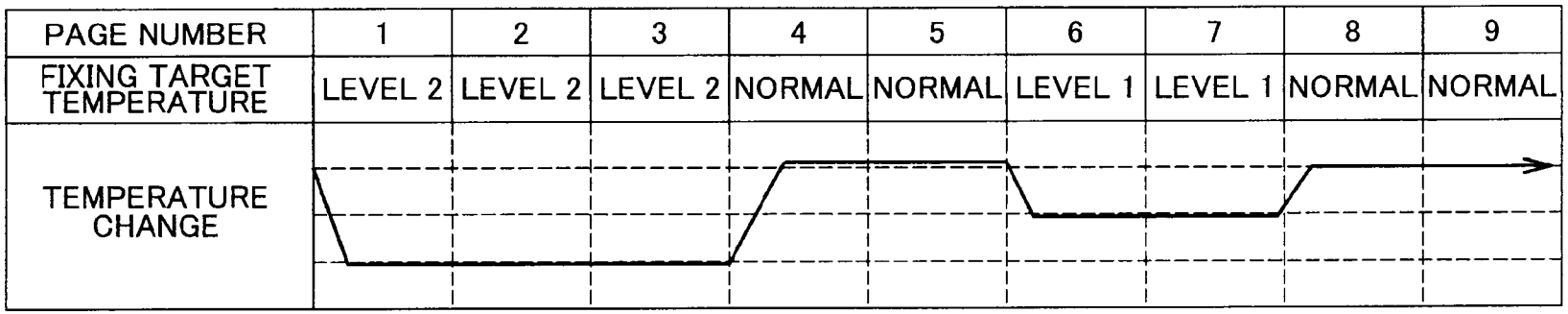
FIG. 19 shows one example of a change in fixing temperature during successive printing.

FIG. 19 shows one example of a fixing temperature change during successive printing according to any one of the above-mentioned embodiments of the present invention.

As described above, in each of the embodiments of the present invention, in a case where printing is carried out successively on plural recording media (i.e., successive printing), the fixing target temperature is selected for each sheet of the recording media. Therefore, there may be a case where the fixing target temperature is changed during successive printing operations between the normal temperature, the level 1 temperature and the level 2 temperature or between the normal temperature, the level 1 temperature, the level 2 temperature and the level 3 temperature.

In the example of FIG. 19, the fixing target temperatures (the normal temperature (normal), the level 1 temperature (level 1) and the level 2 temperature (level 2)) for first through ninth pages on which printing is carried out successively, and a change in the fixing temperature that is changing according to the change in the fixing target temperature are shown. In FIG. 19, in particular between the third and fourth pages, the increasing amount in the fixing target temperature from the level 2 temperature to the normal temperature is large. Therefore, it is necessary to increase the fixing temperature sharply to timely follow the fixing target temperature. However, in a case where the number of sheets to be processed successively per unit period of time (for example, the number of sheets to be processed successively per 1 minute (CPM (copies per minute))) is large, a problem such as cold offset may occur since the fixing temperature may not timely follow the fixing target temperature only during the period of time between adjacent sheets of successively processed recording medium. Therefore, in order to avoid such a problem, the fixing temperature is controlled during successive printing operations as will be described now.

Figure 20:
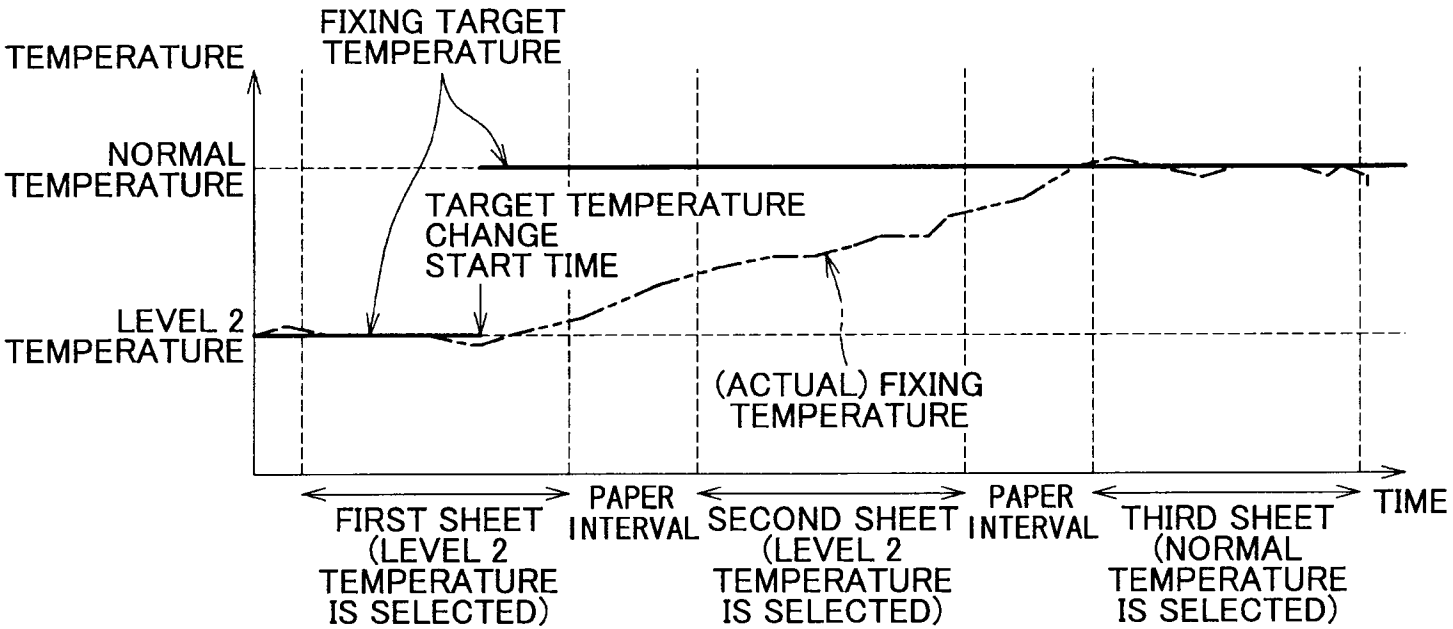
FIGS. 20 and 21 illustrate a timing of starting a change of the fixing target temperature.

FIG. 20 shows a change in the (actual) fixing temperature when, as an example, three sheets of recording media are successively processed where the ordinate indicates temperature and abscissa indicates time. In FIG. 20, a long dashed double-short dashed line represents the (actual) fixing temperature, and a solid line represents the fixing target temperature.

In this case, the fixing target temperature selected for the first and second sheets are the same level 2 temperature, and therefore, the fixing target temperature is not to be changed. However, the fixing target temperature selected for the third sheet is the normal temperature. Therefore, it is necessary to increase the fixing temperature by a large amount between the second and third sheets. In such a case where it is necessary to increase the fixing temperature by a large amount between the second and third sheets, a change of the fixing target temperature from the level 2 temperature to the normal temperature is started before the completion of causing the second sheet to pass through the fixing unit (fixing nip). By thus starting the change of the fixing target temperature from the level 2 temperature to the normal temperature before the completion of causing the second sheet to pass through the fixing nip instead of immediately after the completion of causing the second sheet to pass through the fixing nip, it is possible to start an increase of the (actual) fixing temperature at early timing, and thus, it becomes possible to have increased the fixing temperature to the normal temperature until when the third sheet passes through the fixing nip.

More specifically, the change of the fixing target temperature from the level 2 temperature to the normal temperature is started when the first image forming unit (in the example of FIG. 1, the process unit 1Y for yellow) among the plural image forming units starts image forming operations on the second sheet of recording medium. Thereby, when the second sheet of recording medium is caused to pass through the fixing nip, the surface temperature of the fixing roller as the fixing member has been started to increase from the level 2 temperature to the normal temperature as shown in FIG. 20, and the surface temperature of the fixing roller reaches the normal temperature before the third sheet of recording medium passes through the fixing nip, as shown in FIG. 20.

Figure 21:
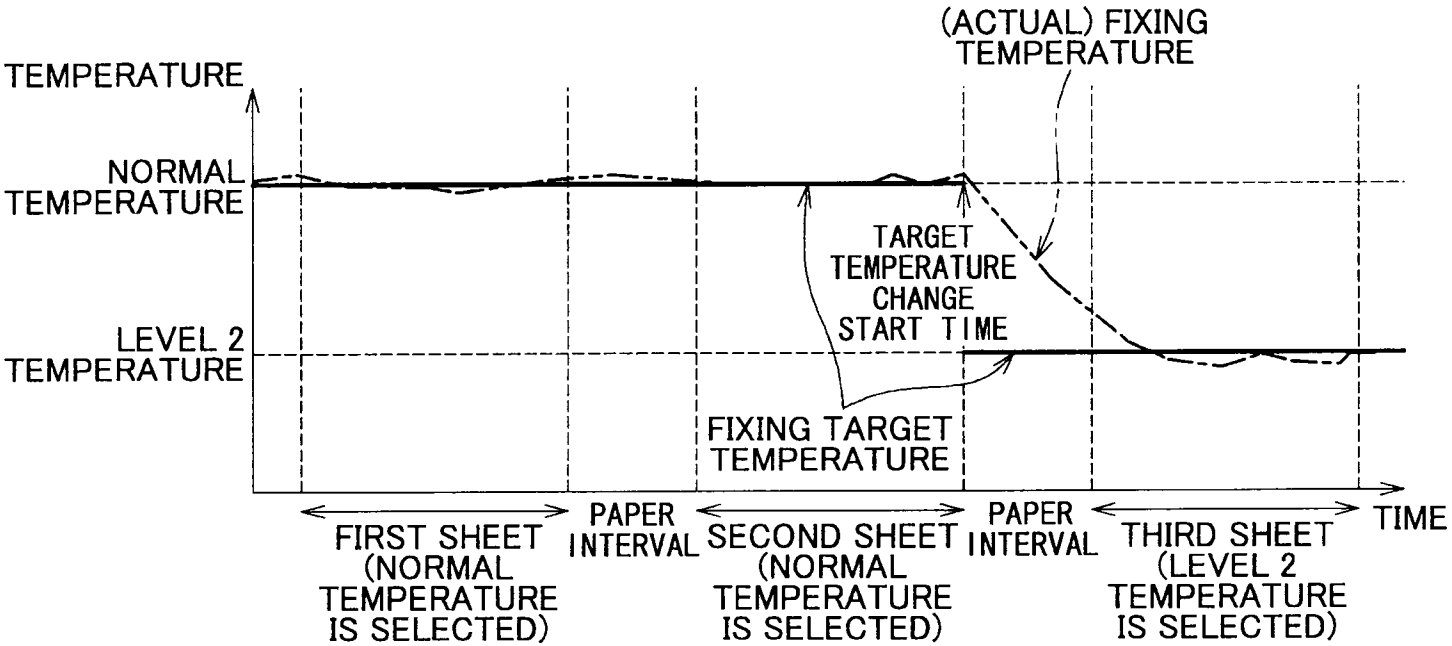

FIG. 21 shows, different from the case of FIG. 20, a change of the (actual) fixing temperature under the condition where the first and second sheets are output with the normal temperature, and the third sheet is output with the level 2 temperature. It is noted that also in FIG. 21, a long dashed double-short dashed line represents the (actual) fixing temperature, and a solid line represents the fixing target temperature.

In this case, it is necessary to change the fixing target temperature from the normal temperature to the level 2 temperature between the second and third sheets. Here, a change of the fixing target temperature is started immediately after the completion of causing the second sheet to pass through the fixing unit (fixing nip), and at a time when causing the third sheet to pass through the fixing nip is started, the fixing temperature has not yet been reduced to the level 2 temperature. However, no problem occurs even when the fixing temperature has not yet been reduced to the level 2 temperature that is the target temperature.

Thus, in a case where the fixing target temperature of a recording medium for which a fixing process is carried out next is higher than the fixing target temperature of a specific recording medium (for example, in the case of FIG. 20), a start of changing the fixing target temperature is carried out at an earlier timing in comparison to a case where the fixing target temperature of a recording medium for which a fixing process is carried out next is lower than the fixing target temperature of a specific recording medium (for example, in the case of FIG. 21). Thereby, even in a case where the number of sheets of recording media to be successively processed per unit period of time is large, it is possible to timely control the fixing temperature for each of recording media during successive processing of the recording media to a desired temperature. Thereby, it is possible to avoid a problem of cold offset or such. Further, since it is not necessary to provide a waiting period of time for waiting until the fixing temperature is sufficiently increased, it is possible to switch the fixing temperature without degradation of productivity (printing speed).

Further, it is also possible to carry out a start of changing the fixing target temperature at an earlier timing as the difference between the fixing target temperatures is larger in a case where the fixing target temperature of a recording medium for which a fixing process is to be carried out next is higher than the fixing target temperature of a specific recording medium. For example, in a case where the fixing target temperature is changed from the level 2 temperature to the normal temperature between the second and third sheets, in comparison to a case where the fixing target temperature is changed from the level 1 temperature to the normal temperature, a time required for increasing the fixing temperature is longer since the temperature difference is larger. Therefore, by starting the change at an earlier timing in a case where the difference between the fixing target temperatures is larger, it is possible to timely complete the increase in the fixing temperature.

It is noted that with reference to FIGS. 20 and 21, the timing at which the change of the fixing target temperature is started has been described using the examples for the temperature change between the level 2 temperature and the normal temperature. However, the timing at which the change of the fixing target temperature is started may be changed in the same way also for the temperature change between the level 3 temperature and the normal temperature or the temperature change between the level 3 temperature and the level 1 temperature, for example.

Figure 22:
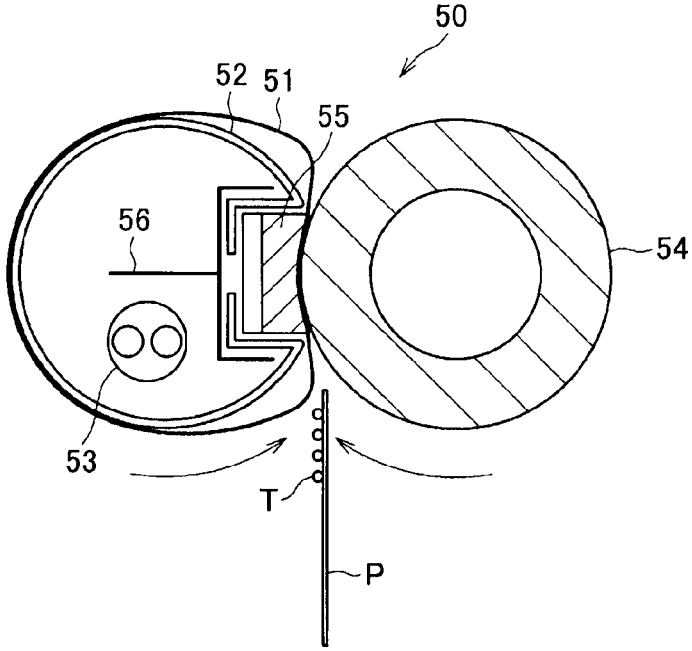
FIG. 22 is a general sectional view showing another configuration of a fixing unit to which any one of the embodiments of the present invention may be applied.

FIG. 22 shows a general sectional view of a configuration of another fixing unit applicable to any one of the above-mentioned embodiments of the present invention. As shown in FIG. 22, the fixing unit 50 includes an endless fixing belt 51 fixing a not-yet-fixed image T on a recording medium P to the recording medium P; a metal pipe 52 as a supporting member supporting an inner circumferential surface of the fixing belt 51; a heater 53 as a heating member heating the fixing belt 51; a pressing roller 54 as a pressing member pressing the fixing belt 51 from the outer circumferential side; a nip creating part 55 disposed on the inner circumferential side of the fixing belt 51 and coming into contact with the pressing roller 54 via the fixing belt 51 to form a fixing nip; and an auxiliary stay 56.

The fixing belt 51 includes a base made of SUS or nickel and a surface layer made of silicone rubber and a surface layer made of PFA coated on the base. The metal pipe 52 has a base made of SUS or nickel, and it is preferable to provide a fluorine-based slidable coating on the outer circumferential surface coming into contact with the fixing belt 51. The pressing roller 54 includes a core metal made of a metal and an elastic layer made of silicone rubber coated on the outer circumferential surface of the core metal. The nip creating part 55 is formed as a result of fluororubber or such being wound by a PTFE sheet or such.

As a result of the heater 53 generating heat, the metal pipe 52 is heated. Thereby, the temperature of the fixing belt 51, with which the metal pipe 52 is contact, is increased. Then, as a result of the recording medium P on which the not-yet-fixed toner image T is formed passing through the fixing nip between the fixing belt 51 being rotated and the pressing roller 54 in a state where the temperature of the fixing belt 51 has reached the fixing target temperature, the not-yet-fixed image T on the recording medium P is fixed. Further, the fixing belt 51, the temperature of which has been reduced through the fixing operation, is heated again by the heater 53, and this flow is repeated.

Figure 23:
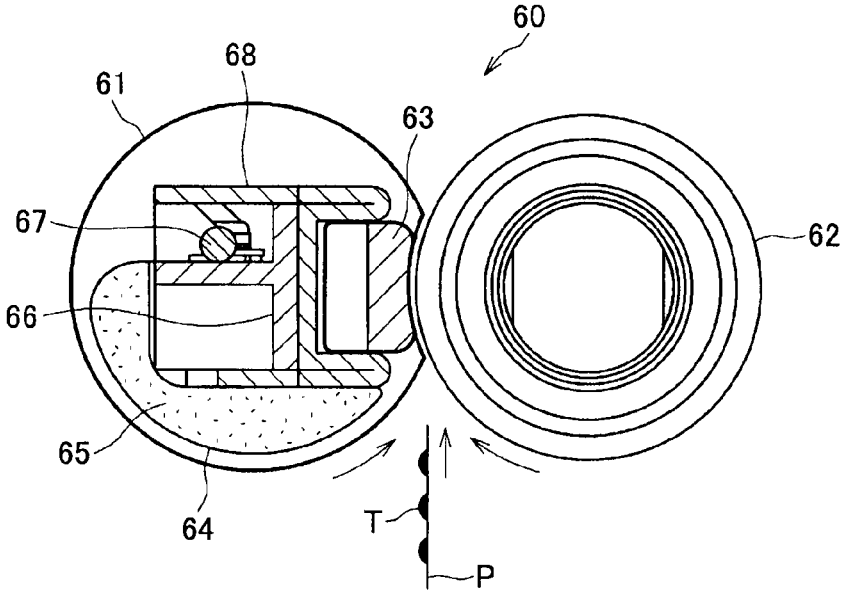
FIG. 23 is a general sectional view showing yet another configuration of a fixing unit to which any one of the embodiments of the present invention may be applied.

FIG. 23 is a general sectional view of a configuration of yet another fixing unit applicable to any one of the above-mentioned embodiments of the present invention.

As shown in FIG. 23, the fixing unit 60 includes a fixing sleeve 61 as a fixing member; a pressing roller 62 as a pressing member pressing the fixing sleeve 61; a nip creating part 63 disposed on the inner circumferential side of the fixing sleeve 61 and coming into contact with the pressing roller 62 via the fixing sleeve 61 to form a fixing nip; a surface-type heating member 64 as a heating member heating the fixing sleeve 61; and a heating member supporting part 65 supporting the surface-type heating member 64 at a certain position. As shown in FIG. 23, the reference numeral 66 denotes a terminal table stay, the reference numeral 67 denotes a power supply line and the reference numeral 68 denotes a core supporting member.

The surface-type heating member 64 is formed as a result of a resistor heating part being disposed in the inside of a deformable film-shaped member. Further, the surface-type heating member is configured to come into contact with the inner circumferential surface of the fixing sleeve 61 and directly heat the fixing sleeve 61. Further, the surface-type heating member 64 may be disposed adjacent to the fixing sleeve 61. In this configuration, a not-yet-fixed image T on a recording medium P is fixed as a result of the recording medium P on which the not-yet-fixed toner image T is formed passing through the fixing nip between the fixing sleeve 61 being rotated and the pressing roller 62 in a state where the temperature of the fixing sleeve 61 has reached the fixing target temperature.

It is noted that the present invention is not limited to the specifically disclosed embodiments, and variations and modifications may be made without departing from the scope of the present invention. A fixing unit to which any one of the above-mentioned embodiments of the present invention is applicable is not limited to the above-described fixing units. For example, a pressing member such as a pressing belt may be used instead of the pressing roller, and a heating member that heats the pressing member may be provided. Further, an image forming apparatus to which any one of the above-mentioned embodiments of the present invention is applicable is not limited to the laser printer shown in FIG. 1, and may be an image forming apparatus such as another type of a printer, a copier, a facsimile machine, a multifunction peripheral having a function of a printer, a copier and a facsimile machine in a combined manner, or such.

Below, the above-mentioned low-temperature-fixing black toner used in the fourth, fifth and sixth embodiments of the present invention will be described in detail.

The low-temperature-fixing black toner used in the fourth, fifth and sixth embodiments of the present invention has a required fixing temperature lower than that of color toners by equal to or more than 10° C., contains at least a thermoplastic resin, and contains as the thermoplastic resins at least crystalline polyester resin and non-crystalline polyester resin, a wax and a colorant. The low-temperature-fixing black toner has a clear endothermic peak at 50 through 10° C. on a differential thermal curve in DSC (Differential Scanning calorimetry) temperature increase, the melting point of the above-mentioned crystalline polyester is 60° C. through 80° C., and the melting point of the wax is 70° C. through 90° C. In a case where the melting point of the crystalline polyester is less than 60° C., degradation in heat resisting storage stability appears, and in a case where the melting point of the crystalline polyester is more than 80° C., degradation in low-temperature fixing performance appears. In a case where the melting point of the wax is less than 70° C., degradation in heat resisting storage stability appears, and in a case where the melting point of the was is more than 90° C., degradation in low-temperature fixing performance appears. Generally speaking, it is preferable that the melting points of the crystalline polyester and the wax are lower because of low-temperature fixing performance. However, if the melting points thereof are too low, heat resisting storage stability may be degraded. Further, as to the wax, it is preferable that the melting point is higher than that of crystalline polyester since the wax tends to be degraded in heat resisting storage stability in comparison to crystalline polyester.

[Organic Solvent]

As an organic solvent, one which completely dissolves crystalline polyester resin at high temperature to form a uniform solution, and on the other hand, which is separated from crystalline polyester when being cooled to a low temperature to form an opaque nonuniform solution is preferable. As specific examples, it is possible to use alone or in a manner of combining two or more of toluene, ethyl acetate, butyl acetate, methyl ethyl ketone, methyl isobutyl ketone and so forth.

[Advantageous Effect of Crystalline Polyester Resin]

Crystalline polyester resin in the toner shows thermofusion characteristics showing a sharp reduction of viscosity near the fixing start temperature since it has high crystallinity. That is, heat resisting storage stability is satisfactory up to immediately before the melting start temperature due to crystallinity, and at the melting start temperature, a sharp reduction of viscosity (sharp melting characteristics) occurs, and thus fixing is achieved. Therefore, it is possible to design the toner having both satisfactory heat resisting storage salability and low-temperature fixing performance. Further, it has been seen that as to a releasing range (a difference between a fixing lower-limit temperature and a hot-offset occurring temperature), satisfactory result is shown.

[Crystalline Polyester Resin]

Crystalline polyester resins are synthesized using, for example, as alcohol ingredients, saturated aliphatic diol compounds having the carbon number of 2 through 12, for example, 1,4-butanediol, 1,6-hexanediol, 1,8-octanediol, 1,10-decanediol, 1,12-dodecanediol and derivatives thereof; and at least as acid ingredients, dicarboxylic acid having the carbon number of 2 through 12 having double bond (C═C bond), or saturated dicarboxylic acid having the carbon number of 2 through 12, especially, fumaric acid, 1,4-butanedioic acid, 1,6-hexanedioic acid, 1,8-octanedioic acid, 1,10-decanedioic acid, 1,12-dodecanedioic acid and derivatives thereof.

Thereamong, from a viewpoint that crystallinity of crystalline polyester is high and a sharp change in viscosity is shown near the melting point, it is preferable to configure crystalline polyester resin by only a saturated diol ingredient having the carbon number of 4 through 12 of any one of 1,4-butanediol, 1,6-hexanediol, 1,8-octanediol, 1,10-decanediol and 1,12-dodecanediol; and a saturated dicarboxylic acid ingredient having the carbon number of 4 through 12 of any one of 1,4-butanedioic acid, 1,6-hexanedioic acid, 1,8-octanedioic acid, 1,10-decanedioic acid and 1,12-dodecanedioic acid.

Further, it has been found that as a result of diligent study for obtaining both low-temperature fixing performance and heat resisting storage stability, it is possible to achieve both low-temperature fixing performance and heat resisting storage stability of crystalline polyester according to the embodiments of the present invention in a case of equal to or more than 60° C. and less than 80° C. In a case of less than 60° C., heat resisting storage stability is degraded, and in a case of equal to or more than 80° C., low-temperature fixing performance is degraded.

Further, as a method of controlling the crystallinity and the softening point of crystalline polyester resin, a method may be cited of designing and using nonlinear polyester obtained from at a time of synthesizing polyester, adding polyhydric alcohol of equal to or more than trihydric such as glycerin to the alcohol ingredient and/or adding polyvalent carboxylic acid of equal to or more than trivalent such as trimellitic anhydride to the acid ingredient, to carry out condensation polymerization.

A molecular structure of crystalline polyester resin according to the embodiments of the present invention can be seen by NMR measurement using a solution or a solid, or, other than it, X-ray analysis, GC/MS, LC/MS, IR measurement or such. More easily, one having absorption based on δCH (out-of-plane bending vibration) of olefin at 956±10 $cm^{-1}$ or 990±10 $cm^{-1}$ in infrared ray absorption spectrum may be cited as an example.

As to molecular weights of crystalline polyester according to the embodiments of the present invention, as a result of diligent study from a viewpoint that one having the above-mentioned molecular weight distribution being sharp and having low molecular weights is superior in low-temperature fixing performance, and heat resisting storage stability is degraded when many ingredients have low molecular weights, it has been seen that low-temperature fixing performance and heat resisting storage stability can be both achieved in a case where in a molecular weight distribution by GPC of soluble ingredients of o-dichlorobenzene, the weight average molecular weight is equal to or more than 5000 and equal to or less than 20,000, a ratio of equal to or less than 500 of number average molecular weight is equal to or more than 0% and equal to or less than 2.5%, and also, a ratio of equal to or less than 1000 of the above-mentioned crystalline polyester Mn is equal to or more than 0% and equal to or less than 5.0%. Further, it is preferably that the ratio of number average molecular weight of equal to or less than 500 is equal to or more than 0% and equal to or less than 2.0%, and also, the ratio of the above-mentioned crystalline polyester Mn of equal to or less than 1000 is equal to or more than 0% and equal to or less than 4.0%.

It is preferable that the acid number and the hydroxyl value of crystalline polyester resin according the embodiments of the present invention, when A denotes the acid number and B denotes hydroxyl value, satisfy the following formulas:

$$10 \text{ mg KOH/g} < A < 40 \text{ mg KOH/g}$$

$$0 \text{ mg KOH/g} < B < 20 \text{ mg KOH/g}$$

$$20 \text{ mg KOH/g} < A+B < 40 \text{ mg KOH/g}$$

In a case where the acid number is equal to or less than 10 mg KOH/g, affinity with paper as the recording medium may be degraded, and heat resisting storage stability may be degraded.

Further, in a case where the acid number is equal to or more than 40 mg KOH/g, or the hydroxyl value is equal to or less than 20 mg KOH/g, electrification capability of the toner under high temperature and high humidity may be degraded.

Further, in a case where the total of the acid number and the hydroxyl value is equal to or less than 20 mg KOH/g, compatibility with noncrystalline polyester may be degraded, and sufficient low-temperature fixing performance may not be obtained. Further, in a case where the total of the acid number and the hydroxyl value is equal to or more than 40 mg KOH/g, compatibility between crystalline polyester and noncrystalline polyester may be increased too much, and heat resisting storage stability may be degraded.

It is preferable that solubility of crystalline polyester to organic solvent at 70° C. is equal to or more than 10 parts by mass. In a case of less than 10 parts by mass, affinity between organic solvent and crystalline polyester may be poor, it may be difficult to disperse crystalline polyester in organic solvent to a submicron size, crystalline polyester existing in the toner may be nonuniform, and degradation in electrification capability and degradation in image quality may occur when using the toner for a long term.

It is preferable that solubility of crystalline polyester in organic solvent at 20° C. is less than 3.0 parts by mass. In a case of equal to or more than 3.0 parts by mass, crystalline polyester dissolved in organic solvent may become easily compatible with noncrystalline polyester before being heated, degradation in heat resisting storage stability, contamination of the development unit, and degradation in images may occur.

It is preferable that the above-mentioned binder resin ingredients contain a binder resin precursor.

Further, as the toner of the embodiments of the present invention, a toner is preferable which is obtained as a result of after dissolving a compound that carries out elongation from or cross-linking with a binder resin precursor into an oil phase obtained from dissolving and dispersing in organic solvent, at least a colorant, a releasing agent, crystalline polyester resin, the above-mentioned binder resin precursor made of modified polyester-based resin, and binder resin ingredients other than these, the above-mentioned oil phase being dispersed into an aqueous medium in which a fine particle dispersing agent exists, to obtain an emulsified dispersion, the above-mentioned binder resin precursor being caused to carry out cross-linking reaction and/or elongation reaction in the emulsified dispersion and the organic solvent being removed.

[Binder Resin Precursor]

As the binder resin precursor, a binder resin precursor made of modified polyester-based resin is preferable, and polyester prepolymer modified by isocyanate, epoxy or such may be cited. This carries out elongation reaction with a compound (amines or such) having active hydrogen groups, and contributes to improving the releasing range (a difference between a fixing lower-limit temperature and a hot-offset occurring temperature). As a method of synthesizing the polyester prepolymer, it is possible to easily synthesize it by causing a known isocyanate-producing agent or epoxidizing agent to react to polyester resin acting as a base. As the isocyanate-producing agents, aliphatic polyisocyanate (tetramethylene diisocyanate, hexamethylene diisocyanate, 2,6-di(isocyanatomethyl)caproate or such); alycyclic polyisocyanate (isohoron diisocyanate, cyclohexylmethane diisocyanate or such); aromatic diisocyanate (tlylene diisocyanate, diphenylmethane diisocyanate or such); aromatic aliphatic diisocyanate ($\alpha,\alpha,\alpha',\alpha'$-tetramethylxylylene diisocyanate or such); isocyanurates; one obtained from the above-mentioned polyisocyanate being blocked by phenol derivative, oxime, caprolactam or such; and combined usage of two or more thereof may be cited. As the epoxidizing agents, epichlorohydrin or such may be cited as a typical example.

Preferably, a ratio of the isocyanate-producing agent is, as an equivalent ratio [NCO]/[OH] of an isocyanate group [NCO] and a hydroxyl group [OH] of polyester as a base, usually 5/1 through 1/1, preferably 4/1 through 1.2/1, and more preferably 2.5/1 through 1.5/1. When [NCO]/[OH] exceeds 5, low-temperature fixing performance may be degraded. When the molar ratio of [NCO] is less than 1, the urea content of the polyester prepolymer is reduced, and hot-offset resisting performance may be degraded.

The content of the isocyanate-producing agent in the polyester prepolymer may be usually 0.5 through 40 percent by weight, preferably 1 through 30 percent by weight, and more preferably 2 through 20 percent by weight. When less than 0.5 percent by weight, hot-offset resisting performance may be degraded, and also, it may be disadvantageous to both heat resisting storage stability and low-temperature fixing performance. Further, when more than 40 percent by weight, low-temperature fixing performance may be degraded.

Isocyanate groups contained per molecule of the polyester prepolymer are usually one or more, preferably 1.5 through 3 on average, and more preferably 1.8 through 2.5 on average. When less than one per molecule, the molecular weight of urea modified polyester resin after elongation reaction may be reduced and hot-offset resisting performance may be degraded.

It is preferable that the weight average molecular weight of the above-mentioned binder resin precursor is equal to or more than $1\times10^4$ and equal to or less than $3\times10^5$.

[Compound Carrying out Expansion from or Cross-Linking with Binder Resin Precursor]

As the compound carrying out expansion from or cross-linking with the binder resin precursor, a compound having active hydrogen groups may be cited, and as a typical one thereof, amines may be cited. As amines, diamine compounds, polyamine compounds having trivalent or more, aminoalcohol compounds, aminomercaptan compounds, amino-acid compounds, compounds blocking these amino groups and so forth may be cited. As diamine compounds, aromatic diamine (phenyl diamine, diethyltoluene diamine, 4,4' diaminodiphenylmethane and so forth); alycyclic diamine (4,4'-diamino-3,3' dimethyl dicyclohexylmethane, diamine cyclohexane, isohoron diamine or such); aliphatic diamine (ethylene diamine, tetramethylene diamine, hexamethylene diamine or such) and so forth may be cited. As polyamine compounds of more than trivalent, diethylenetriamine, triethylene tetramine and so forth may be cited. As aminoalcohol compounds, methanol amine, hydroxyethyl aniline and so forth may be cited. As amino mercaptan compounds, aminoethyl mercaptan, aminopropyl mercaptan and so forth may be cited.

As amino acid compounds, amino propione acid, amino caproic acid and so forth may be cited. As the compounds blocking these amino groups, ketimine compounds obtained from the above-mentioned amines and ketones (acetone, methyl ethyl ketone, methylisobutyl ketone and so forth), oxazoline compounds and so forth may be cited. Preferable ones of these amines are diamine compounds, and mixtures of diamine compounds and few amounts of polyamine compounds.

[Colorant]

As colorant of the embodiments of the present invention, all of known dyes and pigments can be used, and for example, carbon black, nigrosin dye, iron black, naphthol yellow S, hansa yellow (10G, 5G, G), cadmium yellow, yellow iron oxide, yellow ochre, chrome yellow, titanium yellow, polyazo yellow, oil yellow, hansa yellow (GR, A, RN, R), pigment yellow L, benzidine yellow (G, GR), permanent yellow (NCG), vulcan fast yellow (5G, R), tartrazinelake, quinoline yellow lake, anthrazan yellow BGL, isoindolinone yellow, red iron oxide, red lead, lead vermilion, cadmium red, cadmium mercury red, antimoniy vermilion, permanent red 4R, para red, fire red, parachloroorthonitro anilin red, lithol fast scarlet G, brilliant fast scarlet, brilliant carmine BS, permanent red (F2R, F4R, FRL, FRLL and F4RH), fast scarlet VD, vulcan fast rubin B, brilliant scarlet G, lithol rubin GX, permanent red F5R, brilliant carmin 6B, pigment scarlet 3B, bordeaux 5B, toluidine maroon, permanent bordeaux F2K, helio bordeaux BL, bordeaux 10B, bon maroon light, bon maroon medium, eosin lake, rhodamine lake B, rhodamine lake Y, alizarin lake, thioindigo red B, thioindigo maroon, oil red, quinacridone red, pyrazolone red, polyazo red, chrome vermilion, benzidine orange, perinone orange, oil orange, cobalt blue, cerulean blue, alkali blue lake, peacock blue lake, victoria blue lake, metal-free phthalocyanin blue, phthalocyanin blue, fast sky blue, indanthrene blue (RS and BC), indigo, ultramarine, iron blue, anthraquinon blue, fast violet B, methylviolet lake, cobalt purple, manganese violet, dioxane violet, anthraquinon violet, chrome green, zinc green, chromium oxide, viridian, emerald green, pigment green B, naphthol green B, green gold, acid green lake, malachite green lake, phthalocyanine green, anthraquinon green, titanium oxide, zinc flower, lithopone, and mixtures thereof may be used. The content of colorant may be usually 1 through 15 percent by weight per toner, and preferably, 3 through 10 percent by weight with respect to toner.

The colorant used in the embodiments of the present invention may be used as a master batch mixed with resin. Examples of binder resin which is to be used in manufacturing the master batch or kneaded together with the master batch include the above-mentioned modified or unmodified polyester resins; styrenes and polymers of substituted products thereof, such as polystyrenes, poly-p-chlorostyrenes, polyvinyltoluenes and so forth; styrene-based copolymers such as styrene-p-chlorostyrene copolymers, styrene-propylene copolymers, styrene-vinyltoluene copolymers, styrene-vinylnaphthalene copolymers, styrene-methyl acrylate copolymers, styrene-ethyl acrylate copolymers, styrene-butyl acrylate copolymers, styrene-octyl acrylate copolymers, styrene-methyl methacrylate copolymers, styrene-ethyl methacrylate copolymers, styrene-butyl methacrylate copolymers, styrene-methyl α-chloromethacrylate copolymers, styrene-acrylonitrile copolymers, styrene-vinyl methyl ketone copolymers, styrene-butadiene copolymers, styrene-isoprene copolymers, styrene-acrylonitrile-indene copolymers, styrene-maleic acid copolymers, and styrene-maleic acid ester copolymers; polymethyl methacrylates; polybutyl methacrylates; polyvinyl chlorides; polyvinyl acetates; polyethylenes; polypropylenes, polyesters; epoxy resins; epoxy polyol resins; polyurethanes; polyamides; polyvinyl butyrals; polyacrylic acid resins; rosin; modified rosin; terpene resins; aliphatic or alicyclic hydrocarbon resins; aromatic-series-based petroleum resins; chlorinated paraffins; paraffin waxes, and so forth. These may be used alone or in combination.

The master batch may be prepared by mixing and kneading a colorant and a resin prepared for the master batch through application of high shearing force. At this time, an organic solvent may be used for the purpose of improving interaction between the colorant and the resin. Further, a so-called flashing method may be preferably used where an aqueous paste containing the colorant and water is mixed and kneaded with the resin and the organic solvent, thus the colorant is caused to transfer to the resin, and the moisture and the organic solvent ingredient are removed, since the wet cake of the colorant can be directly used (i.e., no drying is required to be performed). In this mixing and kneading, a high-shearing disperser (e.g., three-roll mill or such) is preferably used.

[Releasing Agent]

The releasing agent is preferably a wax having a melting point of 50 through 120° C.

Such a was can effectively act as the releasing agent between the fixing roller and the toner interface, and therefore, it is possible to improve high-temperature offset-resisting performance even without coating a releasing agent such as an oil on the fixing roller.

It is noted that the melting point of the wax may be obtained using a TG-DSC system TAS-100 (Rigaku Corporation) as a differential scanning calorimeter, and measuring the endothermic maximum peak.

As the releasing agent, any one of the following materials may be used.

As waxes, vegetable-based waxes such as carnauba wax, a cotton wax, a Japan wax, a rice wax and so forth; animal-based waxes such as bees wax, lanolin and so forth; mineral-based waxes such as ozokerite, cersin and so forth; petroleum waxes such as paraffin, microcrystalline, petrolatum and so forth, and so forth may be cited. Further, as releasing agents other than these natural waxes, synthesized hydrocarbon waxes such as a fischer-tropsch wax, a polyethylene wax and so forth; synthesized waxes such as ester, ketone, ether and so forth, and so forth may be cited.

Further, fatty amides such as 1,2-amide hydroxystearate, amide stearate, imide phthalic anhydride, chlorinated hydrocarbon and so forth; and as crystalline polymers having low molecular weight, crystalline polymers having long chain alkyl groups on side chains such as homopolymers or copolymers (for example, n-stearyl acrylate-ethyl methacrylate copolymers and so forth) of poly n-stearyl methacrylate, poly n-lauryl methacrylate and so forth, may be used as the releasing agents.

[Electrification Control Agent]

The toner of the embodiments of the present invention may optionally contain an electrification control agent. As the electrification control agents, all of those known as electrification control agents may be used, for example, nigrosin-based dyes, triphenylmethane-based dyes, chrome-containing metal complex dyes, chelate molybdate dyes, rhodamine-based dyes, alkoxy-based amines, quaternary ammonium salts (including fluorine-modified quaternary ammonium salts), alkyl amides, phosphor used alone or as compounds, tungsten used alone and as compounds, fluorine-based activators, salicylate metal salts, metal salts of salicylate derivatives, and so forth.

Specifically, a nigrosin-based dye: Bontron 03; a quaternary ammonium salt: Bontron P-51; a metal-containing azo dye: Bontron S-34; an oxynaphtoic acid-based metal complex; E-82, a salicylic acid based metal complex: E-84; phenol based condensation product: E-89 (the above-mentioned products being made by ORIENT CHEMICAL PINSTRIPED CO., LTD); quaternary ammonium salt molybdenum complexes; TP-302, TP-415 (the above-mentioned products being made by HODOGAYA CHEMICAL CO., LTD.); a quaternary ammonium salt: COPY CHARGE PSY VP2038; a triphenylmethane derivative: COPY BLUE PR; quaternary ammonium salts: COPY CHARGE NEG VP2036, COPY CHARGE NX VP434 (the above-mentioned products being made by HOECHST AG), LRA-901; a boron complex: LR-147 (made by JAPAN CARLIT CO., LTD.); copper phthalocyanine; perylene; quinacridone, azo-based pigment, and polymeric compounds having functional groups such as sulfonate groups, carboxyl groups, quaternary ammonium salts and so forth may be cited.

The amount to use the electrification control agent is determined by the type of the binder resin, whether additives optionally used are used and the toner manufacturing method including the dispersion method, and thus, is not uniquely limited. However, preferably, the electrification control agent is used in a range of 0.1 through 10 parts by weight for 100 parts by weight of the binder resin. A range of 0.2 through 5 parts by weight is more preferably. In a case where 10 parts by weight is exceeded, the electrification performance of the toner is to large, the effect of the main electrification control agent is reduced, the electrostatic attraction force with the development roller is increased, and thus, reduction in flowability of the developer and/or reduction in the image density may occur. The electrification control agent may be dissolved and dispersed after being melted and kneaded together with the master batch and resin. Of course, the electrification control agent may be added at the time of direct dissolution and dispersion in the organic solvent, or may be fixed to the toner surfaces after the toner particles are produced.

[Non-Crystalline Polyester Resin]

According to the embodiments of the present invention, non-crystalline, unmodified polyester resins are used as the above-mentioned binder resin ingredients. The unmodified polyester resin and the modified polyester resin obtained from the binder resin precursor made of the modified polyester based resin being caused to carry out cross-linking and/or expansion reactions are preferably dissolved in each other at least part thereof. Thereby, it is possible to improve the low-temperature fixing performance and hot-offset-resisting performance. Therefore, it is preferable that polyols and carboxylic acids in the modified polyester resin and the unmodified polyester resin have similar compositions. Further, as the unmodified polyester resin, the non-crystalline polyester resin used in the crystalline polyester dispersion may be used if the non-crystalline polyester resin is unmodified.

Suppose that the acid value of the crystalline polyester is A and the acid value of the unmodified polyester resin is C, it is preferable that the following relationship is satisfied:

$$-10 \text{ mg KOH/g} < A - C < 10 \text{ mg KOH/g}$$

In case where the difference between the acid value and the hydroxyl value between the crystalline polyester and the non-crystalline polyester is equal to or more than 10, compatibility and affinity between the crystalline polyester and the non-polyester may be poor, and the low-temperature fixing performance may be inferior. Further, the crystalline polyester may become likely to be exposed on the toner surfaces, and contamination of the development unit and filming may be likely to occur.

It is noted that urea modified polyester resin may be used in combination with polyester resin modified by chemical bond other than urea bond, for example, polyester resin modified by urethane bond, in addition to unmodified polyester resin.

In a case where the toner composition contains modified polyester resin such as urea modified polyester resin, the modified polyester resin may be manufactured by a one-shot process or such.

As one example, a manufacturing method for urea modified polyester resin will now be described.

First, polyol and polycarboxylic acid are heated to 150 through 280° C. in the presence of catalysts such as tetrabutoxytitanate, dibutyltin oxide or such, while, optionally, the pressure is being decreased and water produced is removed, and thus polyester resin having hydroxyl groups is obtained. Next, the polyester resin having the hydroxyl groups and polyisocyanate are reacted at 40 through 140° C., and polyester prepolymer having isocyanate groups is obtained. Further, the polyester prepolymer having the isocyanate groups and amines are reacted at 0 through 140° C., and urea modified polyester resin is obtained.

The number average molecular weight of urea modified polyester resin is usually 1000 through 10000, and is preferably 1500 through 6000.

It is noted that in the case where the polyester resin having the hydroxyl groups and polyisocyanate are reacted and in the case where the polyester prepolymer having the isocyanate groups and amines are reacted, solvents may be used optionally.

As examples of solvents, ones inactive to isocyanate groups such as aromatic solvents (toluene, xylene and so forth); ketones (acetones, methyl ethyl ketones, methyl isobutyl ketones and so forth); esters (ethyl acetates and so forth); amides (dimethyl formamides, dimethyl acetamides and so forth); ethers (tetrahydrofuranes and so forth) and so forth may be cited.

It is noted that in the case where unmodified polyester resin is used in combination, one produced in the same way as the polyester resin having the hydroxyl groups may be mixed in the solution of urea modified polyester resin after the reaction.

As the binder resin ingredients to be contained in the oil phase in the embodiments of the present invention, crystalline polyester resin, non-crystalline polyester resin, binder resin precursor and unmodified resin may be used in combination. Further, it is also possible to contain binder resin ingredients other than these resins. As the binder resin ingredients, it is preferable to contain polyester resins, and it is further preferable to contain polyester resins by equal to or more than 50 percent by weight. If the content of polyethylene resins is less than 50 percent by weight, the low-temperature fixing performance may be degraded. It is especially preferable that all of the binder resin ingredients are polyester resins.

It is noted that as the binder resin ingredients other then polyester resins, styrenes or polymers of styrene substitution products such as polystyrene, poly(p-chlorostyrene), polyvinyltoluene and so forth; styrene-based copolymers such as styrene-p-chlorostyrene copolymer, styrene-propylene copolymer, styrene-vinyltoluene copolymer, styrene-vinylnaphthalene copolymer, styrene-methyl acrylate copolymer, styrene-ethyl acrylate copolymer, styrene-butyl acrylate copolymer, styrene-octyl acrylate copolymer, styrene-methyl methacrylate copolymer, styrene-ethyl methacrylate copolymer, styrene-butyl methacrylate copolymer, styrene-methyl α-chloromethacrylate copolymer, styrene-acrylonitrile copolymer, styrene-vinyl methyl ketone copolymer, styrene-butadiene copolymer, styrene-isoprene copolymer, styrene-acrylonitrile-indene copolymer, styrene-maleic acid copolymer, and styrene-maleic acid ester copolymer; polymethyl methacrylate; polybutyl methacrylate; polyvinyl chloride; polyvinyl acetate; polyethylene; polypropylene; epoxy resin; epoxy polyol resin; polyurethane resin; polyamide resin; polyvinyl butyral; polyacrylic acid resin; rosin; modified rosin; terpene resin; aliphatic or alicyclic hydrocarbon resin; aromatic-series-based petroleum resin; chlorinated paraffin; paraffin wax, and so forth may be cited.

[Toner Manufacturing Method in Aqueous Medium]

As an aqueous medium used in the embodiments of the present invention, water may be used alone or water and a water-miscible solvent are used in combination. Specific examples of usable water-miscible solvents include, but are not limited to, alcohol (methanol, isopropanol, ethylene glycol and so forth), dimethylformamide, tetrahydrofuran, cellosolves (methyl cellosolve and so forth), lower ketones (acetone, methyl ethyl ketone and so forth), and so forth.

The binder resin precursor, colorant, releasing agent, crystalline polyester dispersion, electrification control agent, unmodified polyester resin and so forth, forming the toner particles, may be mixed when the dispersing elements are formed in the aqueous medium. However, it is more preferable that after the toner raw materials are previously mixed, the mixture is added to the aqueous medium and is dispersed. Further, according to the embodiments of the present invention, the other toner raw materials such as the colorant, releasing agent, electrification control agent and so forth are not necessarily mixed previously when the particles are formed in the aqueous medium, and may be added after the particles are formed. For example, after the particles not including the colorant are formed, the colorant may be added by a known dyeing method.

As a method of the dispersion, although is not limited to, known equipment such as one of a low-speed shearing type, a high-speed shearing type, a frictional type, a high-pressure jet type, or an ultrasonic type, for example, may be used. Thereamong, the one of high-speed shearing type is preferable to obtain the particles of the dispersing elements having a particle diameter of 2 through 20 μm. When using the one of high-speed shearing type, although the revolution is not particularly limited to, the revolution may be usually 1,000 through 30,000 rpm, and preferably 5,000 through 20,000 rpm. Although the dispersing time is not particularly limited to, the dispersing time may be usually 0.1 through 60 minutes in a case where a batch system is used. The temperature at a time of the dispersion may be usually 0 through 80° C. (under pressure), and preferably, 10 through 40° C.

The amount of the aqueous medium to use with respect to 100 parts by weight of the toner composition is usually 100 through 1000 parts by weight. When the amount of the aqueous medium is less than 100 parts by weight, the dispersion condition of the toner composition may not be satisfactory, and the toner having a desired particle diameter may not be obtained. When the amount of the aqueous medium exceeds 1000 parts by weight, it may be disadvantageous from an economical viewpoint. Further, optionally, it is possible to use a dispersing agent. The dispersing agent narrows the size distribution of the resulting toner and stabilizes the dispersion.

As a method of causing the polyester prepolymer and the compound having the active hydrogen groups to react, the compound having the active hydrogen groups may be added and be caused to react before the toner composition is dispersed in the aqueous medium, or the compound having the active hydrogen groups may be added after the dispersion in the aqueous medium and reaction may be caused to occur from the particle interfaces. In this case, polyester modified by polyester prepolymer is produced preferentially on the produced toner surfaces and it is possible to provide a concentration gradient in the inside of the particles.

As the dispersing agents used in carrying out emulsion dispersion of the oil phase in which the toner composition is dispersed into a liquid including water, anionic surfactants such as alkylbenzene sulfonate, α-olefin sulfonate and phosphate; amine-salt-type cationic surfactants such as alkylamine salts, amino alcohol fatty acid derivative, polyamine fatty acid derivative and imidazoline; quaternary-ammonium-salt-type cationic surfactants such as alkyl trimethyl ammonium salt, dialkyl dimethyl ammonium salt, alkyl dimethyl benzyl ammonium salt, pyridinium salt, alkyl isoquinolinium salt, and benzethonium chloride; nonionic surfactants such as fatty acid amide derivative, polyvalent alcohol derivative and so forth; ampholytic surfactants, for example, alanine, dodecyl di(aminoethyl)glycine, di(octylaminoethyl)glycine, N-alkyl-N,N-dimethylammonium betaine, and so forth may be cited.

Further, by using surfactants having fluoroalkyl groups, it is possible to obtain the effects even using very small amounts. As anionic surfactants having a fluoroalkyl groups which will be preferably used, fluoroalkyl carboxylic acid having the carbon number of 2 through 10 and metal salt thereof, perfluorooctane sulfonyl glutamic acid disodium, 3-[omega-fluoroalkyl(C6 through C11)oxy]-1-alkyl(C3 through C4) sulfonic acid sodium, 3-[omega-fluoroalkanoyl (C6 through C8)-N-ethylamino]-1-propane sulfonic acid sodium, fluoroalkyl(C11 through C20)carboxylic acid and metal salt thereof, perfluoroalkyl carboxylic acid (C7 through C13) and metal salt thereof, perfluoroalkyl(C4 through C12) sulfonic acid and metal salt thereof, perfluorooctane sulfonic acid diethanol amide, N-propyl-N-(2-hydroxyethyl)perfluorooctane sulfonamide, perfluoroalkyl(C6 through C10)sulfonamide propyl trimethyl ammonium salt, perfluoroalkyl (C6 through C10)-N-ethyl sulfonyl glycine salt, monoperfluoroalkyl(C6 through C16)ethyl phosphate and so forth may be cited.

As trade names, SURFLON S-111, S-112, and S-113 (made by AGC Seimi Chemical Co., Ltd.); FLUORAD FC-93, FC-95, FC-98, and FC-129 (made by Sumitomo 3M); UNIDYNE DS-101 and DS-102 (made by Daikin Industries, Ltd.); MEGAFACE F-110, F-120, F-113, F-191, F-812, and F-833 (made by DIC Corporation); EFTOP EF-102, 103, 104, 105, 112, 123A, 123B, 306A, 501, 201, and 204 (made by Mitsubishi Materials Electronic Chemicals Co., Ltd.); FTERGENT F-100 and F-150 (made by Neos Company Limited) and so forth may be cited.

Further, as cationic surfactants, aliphatic primary, secondary, or tertiary amine acids having fluoroalkyl groups; and aliphatic quaternary ammonium salts such as perfluoroalkyl (C6 through C10)sulfonamide propyl trimethyl ammonium salt, benzalkonium salt, benzethonium chloride, pyridinium salt, imidazolinium salt and so forth may be cited. As trade names, SURFLON S-121 (made by AGC Seimi Chemical Co., Ltd.); FLUORAD FC-135 (made by Sumitomo 3M); UNIDYNE DS-202 (made by Daikin Industries, Ltd.); MEGAFACE F-150 and F-824 (made by DIC Corporation); EFTOP EF-132 (made by Mitsubishi Materials Electronic Chemicals Co., Ltd.); and FTERGENT F-300 (made by Neos Company Limited), and so forth may be cited.

Further, as the dispersing agents for poor-water-soluble inorganic compounds, tricalcium phosphate, calcium carbonate, titanium oxide, colloidal silica, hydroxyapatite, and so forth may be used.

Further, by polymeric protection colloid or water-insoluble organic particles, dispersion liquid droplets may be stabilized. For example, (meth)acryl-based monomers containing acids such as acrylic acid, methacrylic acid, α-cyanoacrylic acid, α-cyanomethacrylic acid, itaconic acid, crotonic acid, fumaric acid, maleic acid, maleic anhydride and so forth, or containing hydroxyl groups, for example, β-hydroxyethyl acrylate, β-hydroxyethyl methacrylate, β-hydroxypropyl acrylate, β-hydroxypropyl methacrylate, γ-hydroxypropyl acrylate, γ-hydroxypropyl methacrylate, 3-chloro-2-hydroxypropyl acrylate, 3-chloro-2-hydroxypropyl methacrylate, diethylene glycol monoacrylate, diethylene glycol monomethacrylate, glycerin monoacrylate, glycerin monomethacrylate, N-methylol acrylamide, N-methylol methacrylamide and so forth, vinyl alcohol and ethers with vinyl alcohol, for example, vinyl methyl ether, vinyl ethyl ether, vinyl propyl ether, esters of compounds containing vinyl alcohol and carboxyl groups, for example, vinyl acetate, vinyl propionate, vinyl butyrate and so forth, acrylamide, methacrylamide, diacetone acrylamide or methylol compounds thereof, acid chlorides such as acrylic acid chloride, methacrylic acid chloride and so forth, homopolymers and copolymers containing nitrogen atoms, nitrogen-containing heterocyclic rings or such, such as vinyl pyridine, vinyl pyrrolidone, vinyl imidazole and ethylene imine, polyoxyethylenes such as polyoxyethylene, polyoxypropylene, polyoxyethylene alkyl amine, polyoxypropylene alkyl amine, polyoxyethylene alkyl amide, polyoxypropylene alkyl amine, polyoxyethylene nonyl phenyl ether, polyoxyethylene lauryl phenyl ether, polyoxyethylene stearyl phenyl ester, polyoxyethylene nonyl phenyl ester and so forth, celluloses such as methyl cellulose, hydroxyethyl cellulose and hydroxypropyl cellulose, and so forth may be used.

In a case where as a dispersion stabilizer, acid and alkali soluble one such as calcium phosphate is used, the calcium phosphate is to be removed from the particulates by a method of water washing or such after the calcium phosphate is dissolved by acid such as hydrochloric acid. Other than this method, the calcium phosphate may be removed by an operation of dissolution by enzyme.

In a case of using the dispersing agent, it is possible that the dispersing agent is to be caused to remain on the toner particle surfaces. However, it is preferable from a viewpoint of electrification performance, to clean and remove the dispersing agent after the reaction.

Further, in order to reduce the viscosity of the toner composition, it is possible to use a solvent by which the polyester obtained from the reaction and the modification of the polyester prepolymer is soluble. Using the solvent is preferable in that the particle size distribution can be narrowed. It is preferable that the solvent is volatile having a boiling point of less than 1001: in that removal thereof becomes easier. As the solvents, for example, toluene, xylene, benzene, carbon tetrachloride, methylene chloride, 1,2-dichloroethane, 1,1,2-trichloroethane, trichloroethylene, chloroform, monochlorobenzene, dichloroethylidene, methyl acetate, ethyl acetate, methylethyl ketone, methylisobutyl ketone and so forth may be used, where these may be used alone or in combination.

Especially, aromatic-series-based solvents, for example, toluene and xylene, and halogenated hydrocarbons such as methylene chloride, 1,2-dichloroethane, chloroform and carbon tetrachloride, are preferred. The content of the solvent is usually 0 through 300 parts, preferably 0 through 100 parts and more preferably 25 through 70 parts, for 100 parts of the polyester prepolymer. When such a solvent is used, the solvent is removed from the resultant product under normal pressure or a reduced pressure after the elongation and/or cross-linking reaction.

The cross-linking reaction time and/or the elongation reaction time is determined depending on the reactivity determined by the combination of the polyester prepolymer and the compound having active hydrogen groups. The cross-linking reaction time and/or the elongation reaction time is usually 10 minutes through 40 hours, and preferably 30 minutes through 24 hours. The reaction temperature is usually 0 through 100° C., and preferably from 10 through 50° C. Further, a known catalyst may be optionally used. Specifically, tertiary amines such as trimethyl amine, imidazole and so forth may be cited.

In order to remove the organic solvent from the obtained emulsified dispersion, a method may be used where the temperature of the entire system is gradually increased, and the organic solvent in the liquid droplets are caused to be completely evaporated and removed. Alternatively, the emulsified dispersion may be sprayed to dried atmosphere, the non water soluble organic solvent in the liquid droplets may be completely removed and the toner particulates may be produced, and further, the aqueous dispersion may be evaporated and removed. As the dried atmosphere to which the emulsified dispersion is sprayed, a gas in which air, nitrogen, carbon dioxide gas, combustion gas or such is heated may be used. Especially, various sorts of air streams, heated to a temperature equal to or more than the boiling point of the used solvent having the highest boiling point, may be generally used. The desired quality can be sufficiently obtained through the process within a short time using a spray drier, a belt drier, a rotary kiln or such.

In a case where the particle size distribution is wide at a time of the emulsion dispersion, and cleaning and drying processes are carried out while the particle size distribution being kept, the particle size distribution may be arranged through a classification operation aiming at a desired particle size distribution.

Through the classification operation, using a cyclone, a decanter, centrifugal separation or such, particulate part can be removed from the liquid. The classification operation may be carried out after the powder obtained after the drying is obtained. However, carrying out the classification operation in the liquid is preferable as doing so has better efficiency. Unwanted particulate part or coarse particles obtained therethrough may be returned to the kneading process and used for forming the particles again. When returning the unwanted particulate part or coarse particles, those particles may be in a wet condition.

The used dispersing agent may preferably be removed from the obtained dispersion liquid as much as possible. The removing may preferably be carried out at the same time with the above-mentioned classification operation.

It is possible to avoid elimination of other particles from the surfaces of the obtained complex particles by mixing together the obtained dried-toner powder and the other particles such as the releasing agent particulates, the electrification control agent particulates, fluidizing agent particulates and the colorant particulates, and/or giving mechanical shocks to the mixed powder so that they can be fixed and fused to the surfaces.

Specific methods thereof include a method of giving impact force to the mixture with high-speed-spinning blades; a method of injecting in a high-velocity air stream, accelerating and causing the particles to collide together or the complex particles to collide with an appropriate collision plate, and so forth. Examples of devices can be used are Ongmill (made by Hosokawa Micron Corporation), a modified I-type Mill (made by Nippon Pneumatic Mfg. Co., Ltd.) in which its grinding air pressure is decreased, Hybridization System (made by NARA MACHINERY CO., LTD.), Kryptron System (made by Kawasaki Heavy Industries, Ltd.), an automatic mortar, and so forth.

[External Additive]

The toner according to the embodiments of the present invention may contain an external additive to assist the fluidity, development performance or electrification performance.

As the external additives, inorganic particulates may be preferably used. The primary particle diameter of the inorganic particulates is preferably 5 nm through 2 μm, and especially preferably 5 nm through 500 nm. The specific surface area based on the BET method is preferably 20 through 500 $m^2/g$. The usage ratio of the inorganic particulates is preferably 0.01 through 5 percent by weight and especially preferably 0.01 through 2.0 percent by weight. Specific examples of the inorganic particulates include, for example, silica, alumina, titanium oxide, barium titanate, magnesium titanate, calcium titanate, strontium titanate, zinc oxide, tin oxide, siliceous sand, clay, mica, wollastonite, diatomaceous earth, chromium oxide, cerium oxide, red iron oxide, antimony trioxide, magnesium oxide, zirconium oxide, barium sulfate, barium carbonate, calcium carbonate, silicon carbide and silicon nitride.

Other than these, listed are polymer-type particulates, for example, polystyrene, methacryl acid ester, acrylic acid ester copolymers, ones of a polycondensation type such as silicone, benzoguanamine and nylon, polymer particulates made from thermosetting resin, which are obtained by soap-free emulsion polymerization, suspension polymerization or dispersion polymerization may be cited.

Such a fluidizing agent may be subjected to a surface treatment to increase hydrophobicity and prevent deterioration of fluidization performance and electrification performance even under high humidity. For example, preferable surface treatment agents include a silane coupling agent, a silylation agent, a silane coupling agent having alkylfluoride groups, an organotitanate-type coupling agent, an aluminum-type coupling agent, silicone oil and modified silicon oil.

Examples of a cleaning property improving agent to remove the developer remaining on the photosensitive members or on the primary transfer medium after the transferring process, include, for example, fatty acid metal salts such as zinc stearate, calcium stearate and stearic acid, polymer particulates or such produced by soap-free emulsion polymerization or such, for example, polymethyl methacrylate particulates, polystyrene particulates and so forth. The polymer particulates preferably have a relatively narrow particle size distribution and the volume mean particle diameter of preferably 0.01 through 1 μm.

Thus, according to the embodiments of the present invention, the information to be obtained for controlling the fixing target temperature is only whether halftone processing is carried out and the information concerning the type of the gradation processing to be used. Therefore, enormous information is not necessary, and also, it is possible to set the most suitable fixing target temperature for the time of fixing process for each sheet of recording media that are being processed successively, without selecting a specific mode. Thereby, it is possible to provide an image forming apparatus matching a recent demand of energy saving and increase in the starting up period of time. Further, it is possible to achieve fine temperature control by combining factors of the type of dither method, the number of lines and so forth as in the above-mentioned second and third embodiments or the fifth and sixth embodiments of the present invention.

Further, as described above with reference to FIG. 20, by being able to change the timing of starting a change of the fixing target temperature according to the difference between the fixing target temperatures before and after the change, it is possible to be able to control the fixing temperature for each of the recording media being processed successively to a desired temperature even in a case where the number of recording media to be processed within a unit time is large. Thereby, it is possible to avoid a problem such as cold offset otherwise occurring because the fixing temperature does not increase to timely follow the fixing target temperature. Further, since it becomes not necessary to provide a period of time for waiting until the fixing temperature increases sufficiently, it is possible to switch the fixing temperature without reducing productivity (printing speed).

The present Patent Application is based on Japanese Priority Patent Applications Nos. 2010-247493 and 2010-253904 filed Nov. 4, 2010 and Nov. 12, 2010, respectively, the entire contents of which are hereby incorporated herein by reference.

What is claimed is:

1. An image forming apparatus including a fixing unit configured to fix a not-yet-fixed image on a recording medium, comprising:

a fixing target temperature changing part configured to change a fixing target temperature at a time of a fixing process; and a gradation processing part configured to carry out gradation processing on image information, wherein, for each sheet of the recording medium on which the fixing process is carried out, the fixing target temperature is selected based on a determination whether halftone processing is to be carried out, and wherein, when halftone processing is to be carried out, the fixing target temperature is selected based on a type of gradation processing to be used.

2. The image forming apparatus as claimed in claim 1, wherein the gradation processing part is configured to use a dither method for the gradation processing, and when the gradation processing is performed by the dither method, the fixing target temperature is selected according to a type of the dither method and a number of lines associated with the type of dither method.

3. The image forming apparatus as claimed in claim 2, wherein the image forming apparatus carries out copy output of outputting image information read from an original image and printer output of outputting image information received from an external apparatus, and when the image forming apparatus carries out the copy output, the gradation processing is carried out according to an error diffusion method, when the image forming apparatus carries out the printer output, the gradation processing is carried out according to the dither method.

4. The image forming apparatus as claimed in claim 3, wherein when the gradation processing is carried out according to the dither method, the fixing target temperature is set lower in comparison to when the gradation processing is carried out according to the error diffusion method.

5. The image forming apparatus as claimed in claim 2, wherein the image forming apparatus has plural image forming modes in which it is possible to change at least one of resolution of an image to be fixed to the recording medium and a number of levels of image dot diameter, and the type of dither method and the number of lines is changed according to a selected image forming mode.

6. The image forming apparatus as claimed in claim 5, further comprising:

an area detection part configured to detect a character/letter area and a photograph area in an image for each sheet of the recording medium, and the type of dither method and the number of lines are changed according to a detection result of the area detection part.

7. The image forming apparatus as claimed in claim 1, wherein a timing of starting a change of the fixing target temperature for a recording medium for which the fixing process is carried out next from the fixing target temperature for a specific recording medium from among plural sheets of recording media to be processed successively is controlled according to a difference between the fixing target temperatures before and after the change of the fixing target temperature.

8. The image forming apparatus as claimed in claim 7, wherein when the fixing target temperature for the recording medium for which the fixing process is carried out next is higher than the fixing target temperature for the specific recording medium, the timing of starting the change of the fixing target temperature is made earlier as the difference in the fixing target temperature is large.

9. The image forming apparatus as claimed in claim 7, wherein when the fixing target temperature for the recording medium for which the fixing process is carried out next is higher than the fixing target temperature for the specific recording medium, the timing of starting the change of the fixing target temperature is made earlier in comparison to when the fixing target temperature for the recording medium for which the fixing process is carried out next is lower than the fixing target temperature for the specific recording medium.

10. The image forming apparatus as claimed in claim 7, wherein when the fixing target temperature for the recording medium for which the fixing process is carried out next is higher than the fixing target temperature for the specific recording medium, the change of the fixing target temperature is started at a time when a first one of plural image forming units of the image forming apparatus starts an image forming operation for the specific recording medium.

11. The image forming apparatus as claimed in claim 7, when the fixing target temperature for the recording medium for which the fixing process is carried out next is lower than the fixing target temperature for the specific recording medium, the change of the fixing target temperature is carried out immediately after the specific recording medium has passed through the fixing unit.

12. The image forming apparatus as claimed in claim 1, wherein the fixing unit includes:

a fixing member configured to fix the not-yet-fixed image on the recording medium to the recording medium;

a pressing member configured to press the fixing member to form a fixing nip; and an induction heating part configured to carry out induction heating on the fixing member.

13. The image forming apparatus as claimed in claim 1, wherein the fixing unit includes:

an endless fixing belt configured to fix the not-yet-fixed image on the recording medium to the recording medium;

a supporting member configured to support an inner circumferential surface of the fixing belt;

a heating member configured to heat the fixing belt;

a pressing member configured to press the fixing belt from an outer circumferential surface thereof; and a nip creating part disposed on an inner circumferential side of the fixing belt and configured to come into contact with the pressing member via the fixing belt to create a nip.

14. The image forming apparatus as claimed in claim 1, wherein the fixing unit includes:

a fixing member configured to fix the not-yet-fixed image on the recording medium to the recording medium; and a pressing member configured to press the fixing member to create a fixing nip; and a heating member configured to heat at least one of the fixing member and the pressing member, wherein the heating member includes a resistor heating part disposed in an inside of a deformable film-shaped member.

15. The image forming apparatus as claimed in claim 1, wherein the image forming apparatus is a full-color image forming apparatus, a required fixing temperature for a black toner is lower by equal to or more than 10° C. than a required fixing temperature for a color toner, and the black toner includes at least thermoplastic resin, and includes as the thermoplastic resins at least crystalline polyester resin, non-crystalline polyester resin, wax and colorant.

16. The image forming apparatus as claimed in claim 1, wherein, when the halftone processing is not carried out, the fixing target temperature is set lower in comparison to when the gradation processing according to an error diffusion method or according to a dither method is used.

17. The image forming apparatus as claimed in claim 1, wherein the fixing target temperature is settable at three different levels, and the fixing temperature changing part selects a temperature associated with any one of the three levels.

18. The image forming apparatus as claimed in claim 17, wherein the three levels of temperature include a normal temperature, a level-1 temperature and a level-2 temperature, and wherein the normal temperature is higher than the level-1 temperature by 5 degrees C., and the normal temperature is higher than the level-2 temperature by 10 degrees C.

19. The image forming apparatus as claimed in claim 18, wherein the fixing target temperature is set to the level-2 temperature when the halftone processing is not carried out.

20. The image forming apparatus as claimed in claim 18, wherein the fixing target temperature is set to the level-1 temperature where the gradation processing according to a dither method is used and to the normal temperature where the gradation processing according to an error diffusion method is used.

* * * * *